US008588983B2

(12) United States Patent
Grabinger et al.

(10) Patent No.: US 8,588,983 B2
(45) Date of Patent: Nov. 19, 2013

(54) ACTUATOR WITH DIAGNOSTICS

(75) Inventors: Cory Grabinger, Maple Grove, MN (US); Torrey William McNallan, Plymouth, MN (US); Daniel Waseen, Minneapolis, MN (US); Adrienne Thomle, Plymouth, MN (US); Scott McMillan, Golden Valley, MN (US)

(73) Assignee: Honeywell International Inc., Morristown, NJ (US)

( * ) Notice: Subject to any disclaimer, the term of this patent is extended or adjusted under 35 U.S.C. 154(b) by 92 days.

(21) Appl. No.: 13/293,051

(22) Filed: Nov. 9, 2011

(65) Prior Publication Data

US 2013/0116834 A1 May 9, 2013

(51) Int. Cl.

| | |
|---|---|
| ***G01M 1/38*** | (2006.01) |
| ***G01M 7/00*** | (2006.01) |
| ***G05B 21/00*** | (2006.01) |
| ***G05B 15/00*** | (2006.01) |
| ***G05D 23/00*** | (2006.01) |
| ***G06F 19/00*** | (2011.01) |
| ***F28F 27/00*** | (2006.01) |

(52) U.S. Cl.
USPC ..... 700/276; 165/200; 702/108; 702/113

(58) Field of Classification Search
USPC ..... 700/276; 165/200; 702/108, 113
See application file for complete search history.

(56) References Cited

U.S. PATENT DOCUMENTS

| | | | | |
|---|---|---|---|---|
| 3,829,848 | A | | 8/1974 | Eickelberg et al. |
| 4,129,847 | A | | 12/1978 | Teichert |
| 4,302,931 | A | | 12/1981 | White et al. |
| 4,628,268 | A | | 12/1986 | Matsubara |
| 4,652,417 | A | | 3/1987 | Sutherland et al. |
| 4,673,920 | A | | 6/1987 | Ferguson et al. |
| 4,688,183 | A | | 8/1987 | Carll et al. |
| 4,742,475 | A | | 5/1988 | Kaiser et al. |
| 4,795,867 | A | * | 1/1989 | Ohi et al. ..... 200/37 R |
| 4,854,852 | A | | 8/1989 | Patton et al. |
| 5,025,206 | A | | 6/1991 | Germer et al. |

(Continued)

FOREIGN PATENT DOCUMENTS

| | | |
|---|---|---|
| DE | 202004011803 | 12/2004 |
| EP | 0511828 | 11/1992 |

(Continued)

OTHER PUBLICATIONS

Honeywell Spyder Lon Programmable, VAV/Unitary Controllers; product data specifications; 24 pages; copyright 2009.*

(Continued)

*Primary Examiner* — Ronald Hartman, Jr.
(74) *Attorney, Agent, or Firm* — Seager Tufte & Wickhem LLC

(57) ABSTRACT

A system incorporating an actuator. The actuator may have a motor unit with motor controller connected to it. A processor may be connected to the motor controller. A coupling for a shaft connection may be attached to an output of the motor unit. The processor may incorporate a diagnostics program. The processor may be connected to a polarity-insensitive two-wire communications bus. Diagnostic results of the diagnostics program may be communicated from the processor over the communications bus to a system controller. If the diagnostic results communicated from the processor over the communications bus to the system controller indicate an insufficiency of the actuator, then an alarm identifying the insufficiency may be communicated over the communications bus to the system controller.

18 Claims, 27 Drawing Sheets

(56) References Cited

U.S. PATENT DOCUMENTS

| | | | | |
|---|---|---|---|---|
| 5,081,405 | A | 1/1992 | Nelson | |
| 5,153,493 | A | 10/1992 | Jornod et al. | |
| 5,159,534 | A | 10/1992 | Hudson et al. | |
| 5,180,959 | A | 1/1993 | Christopher | |
| 5,318,516 | A | 6/1994 | Cosmescu | |
| 5,416,781 | A | 5/1995 | Ruiz | |
| 5,422,553 | A | 6/1995 | MacLennan et al. | |
| 5,431,182 | A | 7/1995 | Brown | |
| 5,446,677 | A * | 8/1995 | Jensen et al. | 700/277 |
| 5,454,273 | A | 10/1995 | Smith | |
| 5,465,031 | A | 11/1995 | Nilssen | |
| 5,584,319 | A | 12/1996 | Cholin | |
| 5,621,398 | A | 4/1997 | Blair et al. | |
| 5,682,329 | A | 10/1997 | Seem et al. | |
| 5,711,480 | A | 1/1998 | Zepke et al. | |
| 5,744,925 | A * | 4/1998 | Madsen | 318/590 |
| 5,848,609 | A | 12/1998 | Marchessault et al. | |
| 6,025,788 | A | 2/2000 | Diduck | |
| 6,035,878 | A | 3/2000 | Adams et al. | |
| 6,051,948 | A | 4/2000 | Vepy | |
| 6,059,046 | A | 5/2000 | Lowry | |
| 6,178,997 | B1 | 1/2001 | Adams et al. | |
| 6,249,100 | B1 | 6/2001 | Lange | |
| 6,415,617 | B1 * | 7/2002 | Seem | 62/186 |
| 6,431,203 | B1 | 8/2002 | Zhu et al. | |
| 6,431,231 | B1 | 8/2002 | Zhu et al. | |
| 6,443,422 | B1 | 9/2002 | Gluf, Jr. | |
| 6,838,988 | B2 | 1/2005 | Lennartz et al. | |
| 6,851,620 | B2 | 2/2005 | Hill | |
| 6,915,171 | B2 | 7/2005 | Mayer | |
| 6,922,123 | B2 | 7/2005 | Lalonde et al. | |
| 6,954,044 | B2 | 10/2005 | McMillan et al. | |
| 6,979,965 | B2 | 12/2005 | McMillan et al. | |
| 7,021,072 | B2 | 4/2006 | McMillan et al. | |
| 7,031,880 | B1 | 4/2006 | Seem et al. | |
| 7,033,268 | B2 | 4/2006 | Caliendo et al. | |
| 7,058,542 | B2 | 6/2006 | Hauhia et al. | |
| 7,066,273 | B2 | 6/2006 | Tan | |
| 7,079,831 | B2 | 7/2006 | Schwartzman et al. | |
| 7,188,481 | B2 | 3/2007 | DeYoe et al. | |
| 7,241,218 | B2 | 7/2007 | Van Becelaere et al. | |
| 7,265,512 | B2 | 9/2007 | McMillan et al. | |
| 7,378,980 | B2 | 5/2008 | McFarland | |
| 7,401,541 | B2 | 7/2008 | McCarroll et al. | |
| 7,442,068 | B2 | 10/2008 | Hammer et al. | |
| 7,446,494 | B2 | 11/2008 | Grabinger et al. | |
| 7,451,759 | B2 | 11/2008 | Weiss et al. | |
| 7,460,013 | B1 | 12/2008 | Osborne et al. | |
| 7,476,988 | B2 | 1/2009 | Mulhouse et al. | |
| 7,477,028 | B2 | 1/2009 | Bokusky et al. | |
| 7,492,233 | B2 | 2/2009 | Grabinger | |
| 7,525,266 | B2 | 4/2009 | Bolusky et al. | |
| 7,557,549 | B2 | 7/2009 | Underhill | |
| 7,586,279 | B2 * | 9/2009 | Theunissen et al. | 318/466 |
| 7,622,828 | B2 | 11/2009 | Grabinger et al. | |
| 7,633,393 | B2 | 12/2009 | Bonne | |
| 7,636,613 | B2 | 12/2009 | Borah et al. | |
| 7,639,127 | B2 | 12/2009 | Kastli | |
| 7,653,459 | B2 | 1/2010 | Pouchak et al. | |
| 7,664,573 | B2 | 2/2010 | Ahmed | |
| 7,672,913 | B2 | 3/2010 | Kaplan et al. | |
| 7,697,492 | B2 | 4/2010 | Petite | |
| 7,774,441 | B2 * | 8/2010 | Frutiger et al. | 709/221 |
| 7,784,291 | B2 | 8/2010 | Butler et al. | |
| 7,787,994 | B2 | 8/2010 | Wacker | |
| 7,798,170 | B2 | 9/2010 | Hotz et al. | |
| 7,802,734 | B2 | 9/2010 | Stanimirovic | |
| 7,831,338 | B1 | 11/2010 | Haydu | |
| 7,840,311 | B2 | 11/2010 | Grohman | |
| 7,852,765 | B2 | 12/2010 | Neuman et al. | |
| 7,876,217 | B2 | 1/2011 | Laackmann et al. | |
| 7,881,678 | B2 | 2/2011 | Menden et al. | |
| 7,891,241 | B2 | 2/2011 | McSheffrey et al. | |
| 7,944,672 | B1 | 5/2011 | Chiang | |
| 7,966,438 | B2 | 6/2011 | Punyko et al. | |
| 8,031,650 | B2 | 10/2011 | Petite et al. | |
| 8,147,302 | B2 * | 4/2012 | Desrochers et al. | 454/228 |
| 8,218,547 | B2 | 7/2012 | Van Steen et al. | |
| 2002/0152298 | A1 * | 10/2002 | Kikta et al. | 709/223 |
| 2003/0052180 | A1 | 3/2003 | Huhn et al. | |
| 2004/0064216 | A1 * | 4/2004 | Coogan et al. | 700/275 |
| 2004/0124797 | A1 | 7/2004 | Takeuchi et al. | |
| 2006/0130502 | A1 * | 6/2006 | Wruck et al. | 62/186 |
| 2007/0120664 | A1 | 5/2007 | Bilbrey et al. | |
| 2007/0226318 | A1 | 9/2007 | Rydberg et al. | |
| 2008/0051024 | A1 | 2/2008 | Caliendo et al. | |
| 2008/0244104 | A1 | 10/2008 | Clemente | |
| 2008/0258253 | A1 | 10/2008 | Fey et al. | |
| 2008/0316039 | A1 | 12/2008 | White et al. | |
| 2009/0005917 | A1 | 1/2009 | Hole | |
| 2009/0033513 | A1 | 2/2009 | Salsbury et al. | |
| 2009/0082880 | A1 | 3/2009 | Saunders | |
| 2009/0101725 | A1 | 4/2009 | Dolan et al. | |
| 2010/0077254 | A1 | 3/2010 | Erdmann et al. | |
| 2010/0102973 | A1 | 4/2010 | Grohman et al. | |
| 2010/0106262 | A1 | 4/2010 | Schreyer et al. | |
| 2010/0106836 | A1 | 4/2010 | Schreyer et al. | |
| 2010/0109675 | A1 | 5/2010 | Wong et al. | |
| 2010/0121613 | A1 | 5/2010 | Rosca et al. | |
| 2010/0141243 | A1 | 6/2010 | Divicino et al. | |
| 2010/0253270 | A1 | 10/2010 | Kuster et al. | |
| 2011/0070904 | A1 | 3/2011 | McFarland | |

FOREIGN PATENT DOCUMENTS

| | | |
|---|---|---|
| EP | 1170036 | 1/2002 |
| EP | 1901145 | 3/2008 |
| EP | 2241834 | 10/2010 |
| GB | 1172789 | 12/1969 |
| JP | 57086544 | 5/1982 |
| JP | 60091411 | 5/1985 |
| JP | 63257802 | 10/1988 |
| JP | 1215633 | 8/1989 |
| JP | 2009118155 | 5/2009 |
| WO | WO 2010000077 | 1/2010 |

OTHER PUBLICATIONS

WO 2010/000077 A1; Tiemann et al.; 48 pages; published Jan. 7, 2010.*

"555 Timer IC," Wikipedia, the Free Encyclopedia, 9 pages, Aug. 7, 2012.

Beckhoff New Automation Technology, "Application Note DK9222-0810-0035, I/O, Building Automation," 7 pages, Aug. 2010.

Belimo, "Belimo Gateway MP to Modbus RTU-UK24MOD," Product Information, 20 pages, Feb. 2010.

Belimo, "Damper Actuator Plug-In Description/Documentation #Tools-007-E_20.11.05," 11 pages, Nov. 20, 2005.

Belimo, "MP-Bus-Interface—for Belimo Damper Actuators," 16 pages, Oct. 2009.

Belimo, "Perfect for Each and Every Connection, Bus Integration of Actuators and Sensors in Heating, Ventilation, and Air Conditioning Systems," 10 pages, prior to Sep. 30, 2011.

Belimo, "Ring Bus Solution by Belimo, State of the Art System for Bus Integrated Fire Protection and Smoke Control," 6 pages, prior to Sep. 30, 2011.

U.S. Appl. No. 13/250,889, filed Sep. 30, 2011.

U.S. Appl. No. 13/278,694, filed Oct. 21, 2011.

U.S. Appl. No. 13/291,928, filed Nov. 8, 2011.

U.S. Appl. No. 13/293,029, filed Nov. 9, 2011.

U.S. Appl. No. 13/293,041, filed Nov. 9, 2011.

Delta Controls, "HVAC Application Controllers DVC-V322," Document Edition 2.0, 7 pages, Feb. 2005.

Distech Controls, "ECC-VAV/ECC-VVT easyCONTROLS LonMark Certified Application Specific Single Duct Variable Air Volume/Variable Volume Temperature Controllers," 5 pages, prior to Sep. 30, 2011.

Echelon, "LNS Plug-In Belimo," 1 page, 2011.

Honeywell, "3 Nm, 5 Nm Series Spring Return Direct Coupled Actuators, MS3103, MS3105, MS4103, MS4105, MS7403, MS7405, MS7503, MS7505, MS8103, MS8105," Installation Instructions, 12 pages, 2011.

(56) References Cited

OTHER PUBLICATIONS

Honeywell, "Advanced Control from a Unitary Controller," 8 pages, Mar. 2009.
Honeywell, "Jade Economizer Module (Model W7220)," Installation Instructions, 20 pages, 2010.
Honeywell, "ML4202, ML4302, ML4702, ML4802, ML8202, ML8302 Fast-Acting, Two-Position Actuators for Fire/Smoke Control Applications," Installation Instructions, 4 pages, 2005.
Honeywell, "SO5, S10, S20 Series Spring Return Direct Coupled Actuators, MS4105, MS4110, MS4120, MS71XX, MS7505, MS7510, MS7520, MS8105, MS8110, MS8120," Product Data, 16 pages, 2008.
Johnson Controls Unitary Products, "YCCS Zone Bypass Damper Assembly," 6 pages, 2008.
Microchip Technology, Inc., "Using PWM to Generate Analog Output AN538," 2 pages, 1997.
Motorola, "Triacs Silicon Bidirectional Triode Thyristors," 2 pages, prior to Sep. 30, 2011.
MP-Bus Technology by Belimo, "MP-Bus Convenient and Secure Integration of Belimo Actuator Drives," 1 page, prior to Sep. 30, 2011.
Noliac, "Noliac Acquires Piezo Actuator Drive Technology from Siemens," 2 pages, prior to Sep. 30, 2011.
On Semiconductor, "AND8054/D Designing RC Oscillator Circuits with Low Voltage Operational Amplifiers and Comparators for Precision Sensor Applications," 3 pages, Jul. 2001.
Siemens, "BACnet ATEC," Technical Specification Sheet Document No. 149-825, 4 pages, Apr. 9, 2010.
Siemens, "Siemens, BACnet VAV Actuator," Technical Specification Sheet Rev. AA, 5 pages, Jan. 2008.
Tridium, "Belimo and Tridium to Jointly Develop a Next Generation VAV Controller with Wireless Communications," 2 pages, May 15, 2008.
Wang et al., "Research on Reliability of a Hybrid Three-Redundant Electro-Mechanical Actuator," Proceedings of the 2009 IEEE International Conference on Mechatronics and Automation, Aug. 9-12, 2009.

* cited by examiner

PZ

ACTUATOR WITH DIAGNOSTICS

BACKGROUND

The present disclosure pertains to control devices and particularly to mechanical movers of devices. More particularly, the disclosure pertains of actuators.

SUMMARY

The disclosure reveals a system incorporating an actuator. The actuator may have a motor unit with motor controller connected to it. A processor may be connected to the motor controller. A coupling for a shaft connection may be attached to an output of the motor unit. The processor may incorporate a diagnostics program. The processor may be connected to a polarity-insensitive two-wire communications bus. Diagnostic results of the diagnostics program may be communicated from the processor over the communications bus to a system controller. If the diagnostic results communicated from the processor over the communications bus to the system controller indicate an insufficiency of the actuator, then an alarm identifying the insufficiency may be communicated over the communications bus to the system controller.

DESCRIPTION

Coupled actuators may be used within heating, ventilating and air-conditioning (HVAC) systems. They may drive final control elements. Example applications may incorporate volume control dampers, mounted directly to the drive shaft of the actuator or remotely with the use of accessory hardware, rotary valves such as ball or butterfly valves mounted directly to the actuator drive shaft, and linear stroke or cage valves mounted with linkages to provide linear actuation. The actuator may also be used to operate ventilation flaps, louvers and other devices. The actuator may be a spring return device designed for clockwise or counterclockwise fail-safe operation with a continuously engaged mechanical spring. The spring may return the actuator or the mechanism that the actuator is operating to a fail-safe position within a certain time of power loss. An example of the certain time may be 25 seconds. The actuator may be mounted to provide clockwise or counterclockwise spring return by flipping or turning the unit over. The stroke of the actuator may be adjusted for an application at hand. An auxiliary knob may be used to control minimum position or switch position. For switch position, a degree of rotation may be selected for where the switch is desired to activate. The actuator may have an override of the control signal for certain applications such as for example freeze protection. The override may move the actuator to a full open or full closed position. One instance of position change is that the actuator may be designed to respond to direct digital control (DDC) instantaneous contact closures.

Figure 1:
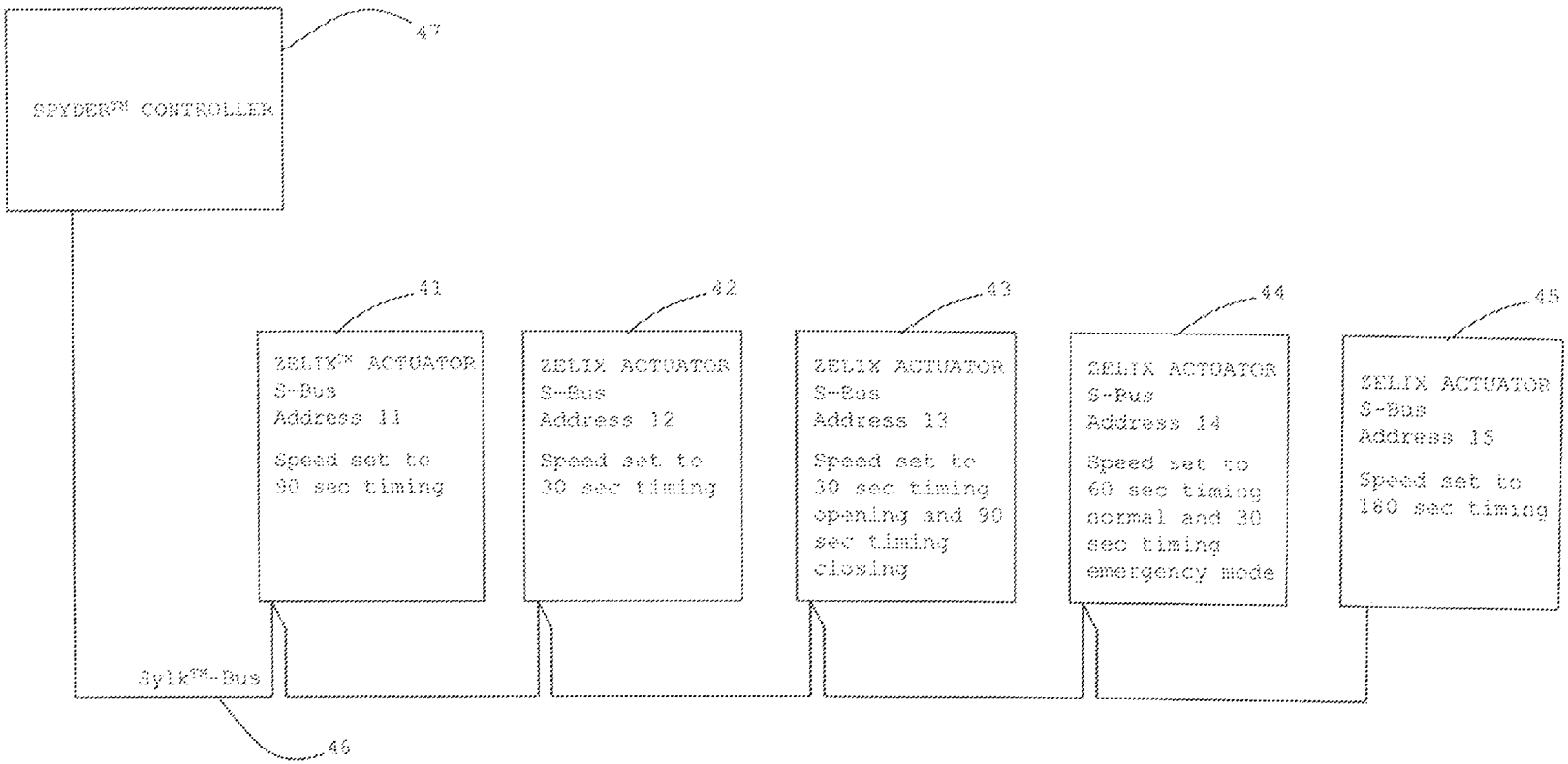
FIG. 1 is a diagram of an example layout of actuators and a controller connected to a common bus.

FIG. 1 is a diagram of an example layout of actuators 41, 42, 43, 44 and 45 connected to a common bus 46. Bus 46 may be connected to a controller 47. Controller 47 may be Spyder controller. Bus 46 may be a Sylk bus. The actuators may be Zelix actuators. Each actuator may have its open and close speeds individually set by controller 47 via signals on bus 46. For examples of various settings, actuator 41 may have a speed set to a 90 second timing, actuator 42 a speed set to a 30 second timing; actuator 43 a speed set to a 30 second timing for opening and a 90 second timing for closing, actuator 44 a speed set to a 60 second timing for a normal mode and a 30 second timing for an emergency mode, and actuator 45 a speed set for a 180 second timing. The speeds each of the actuators may be set to different timings. When a speed of an individual actuator is set by controller 47, the respective actuator may be selected according to its address. Fir instance, actuators 41, 42, 43, 44 and 45 may have addresses 11, 12, 13, 14 and 15, respectively.

Figure 2:
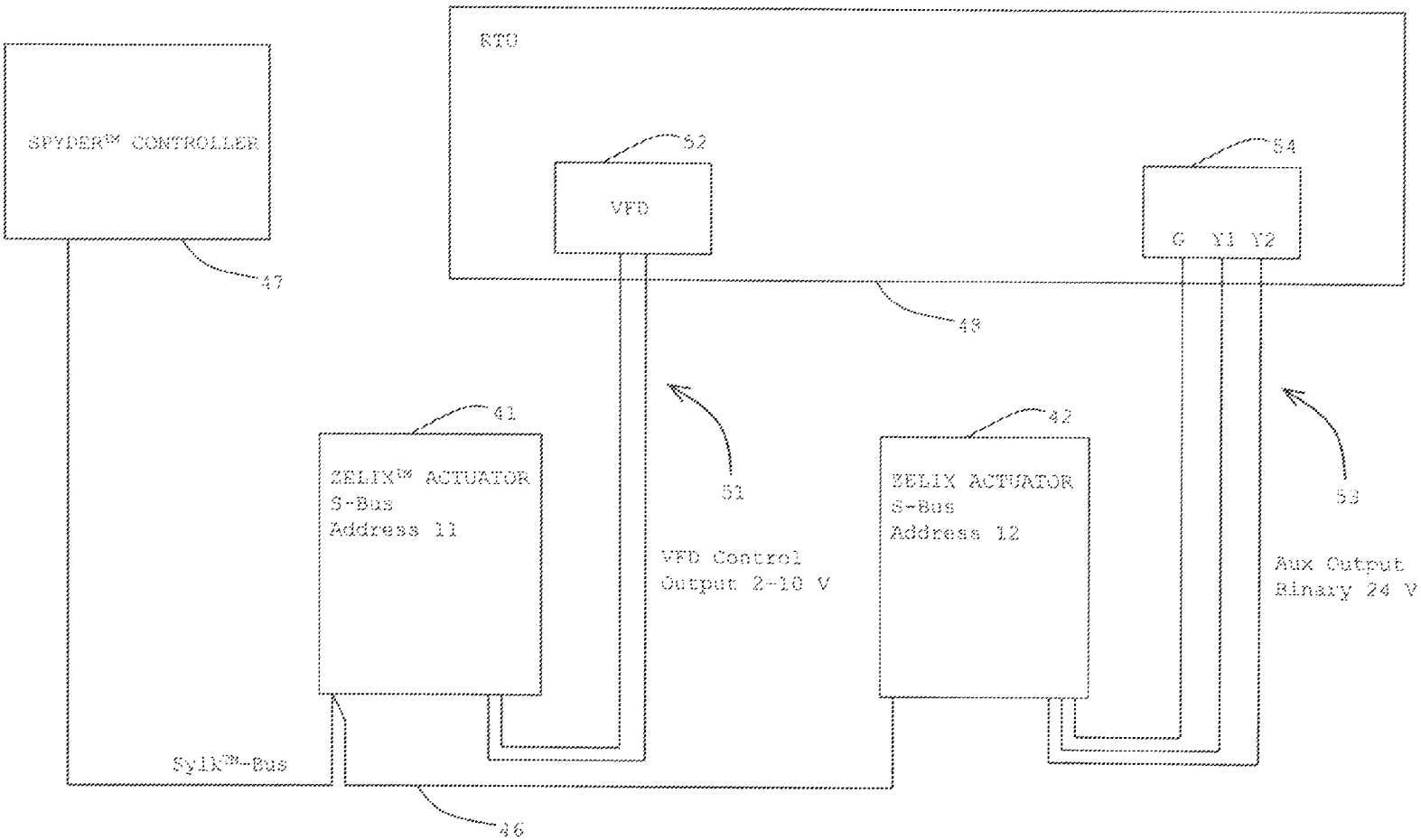
FIG. 2 is a diagram of actuators connected to a controller via a bus and to a roof top unit.

FIG. 2 is a diagram of actuators 41 and 42 connected to controller 47 via bus 46. Actuators 41 and 42 may have connections to a roof top unit (RTU) 48. Actuator 41 may have a variable frequency drive control output of 2 to 10 volts along lines 51 to a component 53 at RTU 48. Actuator 42 may have an auxiliary output binary 24 volts along lines to a component 54 of RTU 48.

A present actuator with an auxiliary output may be adjustable via network communications. Auxiliary (aux) switches on actuators in some of the related art may have their setpoints established locally on the actuator. Setting an auxiliary switch setpoint may be rather difficult because of an actuator location (e.g., in a ceiling or behind equipment) and in general auxiliary switch setpoint user interfaces may be difficult to set and see (e.g., cam systems, rotating assemblies and adjustable detents) which could lead to setpoint inaccuracies. Also, there may be a fixed hysteresis with each of these solutions.

An additional problem with some of the solutions in the related art is that they are not necessarily adjustable as a relevant application changes. For example, an aux switch may be set to make or break at around 45 degrees of the actuator's stroke. If set for 45 degrees, the aux switch may virtually always trip at that position and can not necessarily be changed without a service technician physically changing the setpoint. Some applications would benefit by having the aux switch make at 20 degrees while opening, and break at 60 degrees while closing, or 20 degrees during a heat mode and 45 degrees during a cool mode, or vice versa.

Also, some of the aux switches of the related art may only be able to change state based on an actuator shaft position. There may be many applications where switching the aux switch based on temperature or some other variable (or combination of variables) would be beneficial.

The present approach may solve the issues by allowing the auxiliary switch setpoint and control parameters to be configured remotely over the bus in real time. This approach may be implemented with digital or analog outputs and there could be a multiple setpoint per relay solution.

The present approach may be effected by enhancing the software in the controller and communicating actuator systems. It may be used by allowing the auxiliary switch parameters to be programmable via a higher order controller. An example may incorporate using a Jade controller or Spyder™ controller with Niagara™ (or Fishsim™) to program the functionality of a Sylk™ Zelix™ communicating actuator over a Sylk bus. A Sylk bus may be a two-wire, polarity insensitive bus that may provide Communications between a Sylk-enabled actuator and a Sylk-enabled controller. An example of the Sylk bus circuitry may be disclosed in U.S. Pat. No. 7,966,438, issued Jun. 21, 2011, and entitled "Two-wire Communications Bus System". U.S. Pat. No. 7,966,438, issued Jun. 21, 2011, is hereby incorporated by reference.

Figure 3:
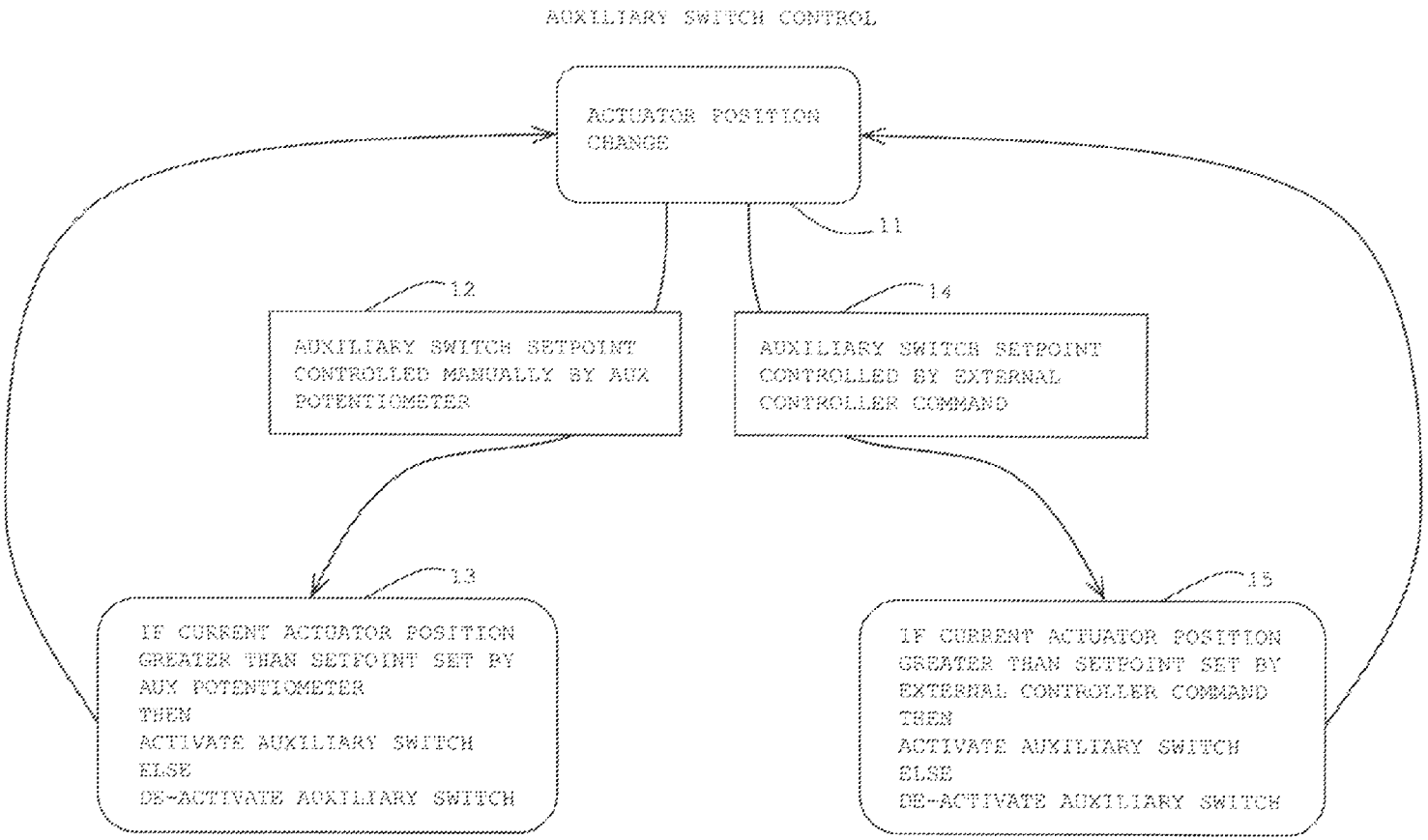
FIG. 3 is a diagram of an auxiliary switch setpoint control approach.

FIG. 3 is a diagram of an auxiliary switch control approach. Symbol 11 may indicate an auxiliary position change which may be initiated. An auxiliary switch setpoint may be controlled manually by an auxiliary potentiometer in symbol 12. Symbol 13 indicates that if the current actuator position is greater than the setpoint set by the auxiliary potentiometer, then the auxiliary switch may be activated. If not, then the auxiliary switch may be deactivated. Alternatively, in symbol 14, the auxiliary switch setpoint may be controlled by an external controller command. Symbol 15 indicates that if the current actuator position is greater than the setpoint set by an external controller command, then the auxiliary switch may be activated. If not, then the auxiliary switch may be deactivated.

A present communicating actuator may have a network adjustable running time. Applications in the field may require or benefit from different running time actuators. In the related art, different running time actuators might be purchased by model number, or programmable actuators may be programmed at commissioning using an independent tool. This situation may dictate that a person pick one running time for the actuator and application at the beginning of an implementation of the actuator.

An example of an issue of running time may occur during system checkout in an OEM factory or in the field. An OEM or field technician may prefer a fast running time (10 seconds) so that the actuator system can be checked out quickly without having to wait for a 90 second actuator to run its time.

The present approach may incorporate an actuator that allows programmable running time via the local bus. Over the bus, the actuator's running time may be programmed to different values at different times during the actuator's lifecycle. For example, the actuator may be programmed for 15 second timing during a test, 30 second timing during a normal application mode, and 90 second timing during a saver mode.

The present actuator approach may be applied in a Jade™ economizer/Sylk Zelix system implementation. The Sylk bus hardware may be implemented on the controller and the actuator. Then the firmware in these products may be created to implement the adjustable running time functionality.

Figure 4:
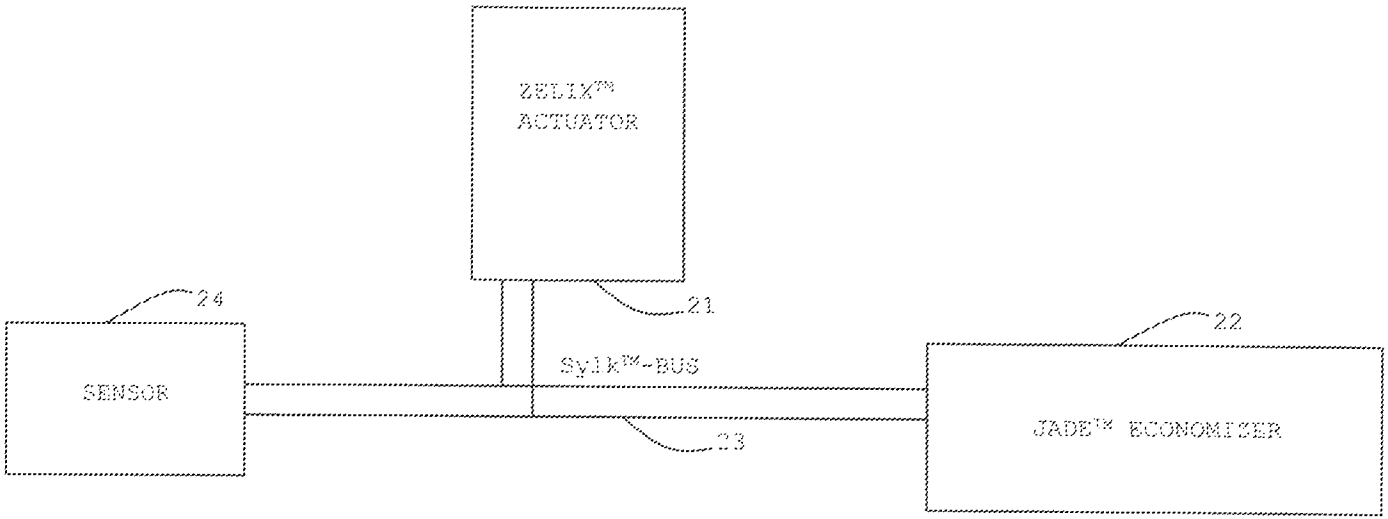
FIG. 4 is a diagram of an actuator, an economizer and sensor connected to one another via a bus.

FIG. 4 is a diagram of a Zelix actuator 21 with Jade economizer 22 connected to the actuator via a Sylk bus 23. A sensor 24 may be connected into the Sylk bus.

A present approach may incorporate a potentiometer address selection for an actuator. Setting a network address on a communicating actuator may be rather difficult. The actuator may be typically located in a hard to reach area (e.g., in a ceiling or behind equipment). Related art approaches may involve actuators that are typically small and hard to see and actuate (e.g., with dip switches/rotary encoders) and may use binary techniques as described herein which may require multiple microcontroller input pins.

The present approach may solve the issue by using a potentiometer to set and establish a network address on a communication actuator. The approach may allow for an address selector to be accessible from both sides of the actuator using a single potentiometer, the numbers and interface to be large and easy to read, and it may allow the address to be selected using only one analog input on the microcontroller.

Figure 5:
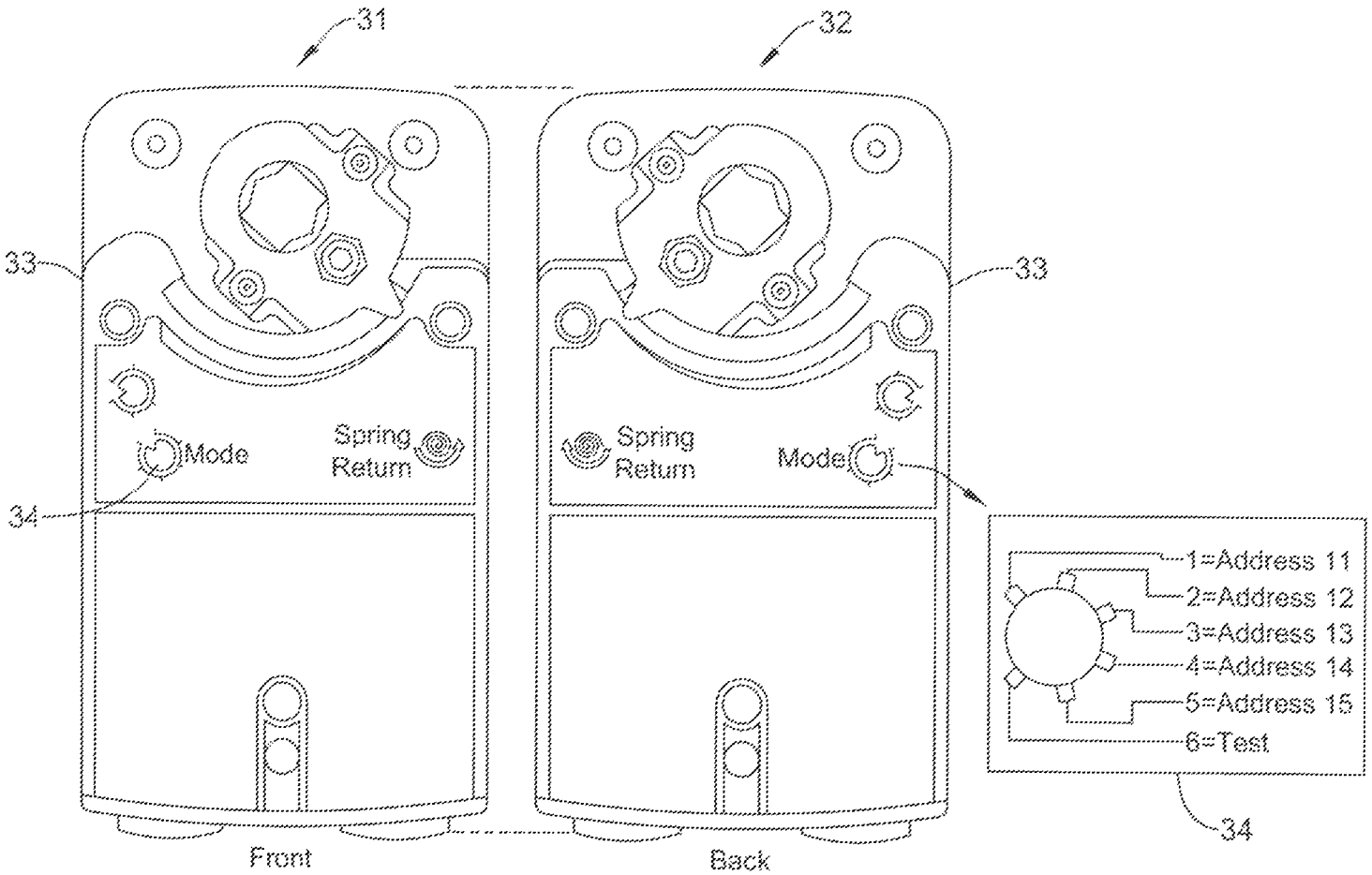
FIG. 5 is a diagram of front and back sides of an actuator revealing certain knobs for control and adjustment such as an address selector being accessible from both sides.

FIG. 5 is a diagram of a front view 31 of an actuator 33 and a back view 32 of the actuator. Certain knobs for control and adjustment such as an address selector 34 may be accessible from both sides of actuator 33. Selector 34 may have five positions for address selection. For instance, a position 1 may be for selecting an address 11, position 2 for address 12, position 3 for address 13, position 4 for address 14 and position 5 for address 15. A position 6 may be for selecting a test mode.

Figure 6:
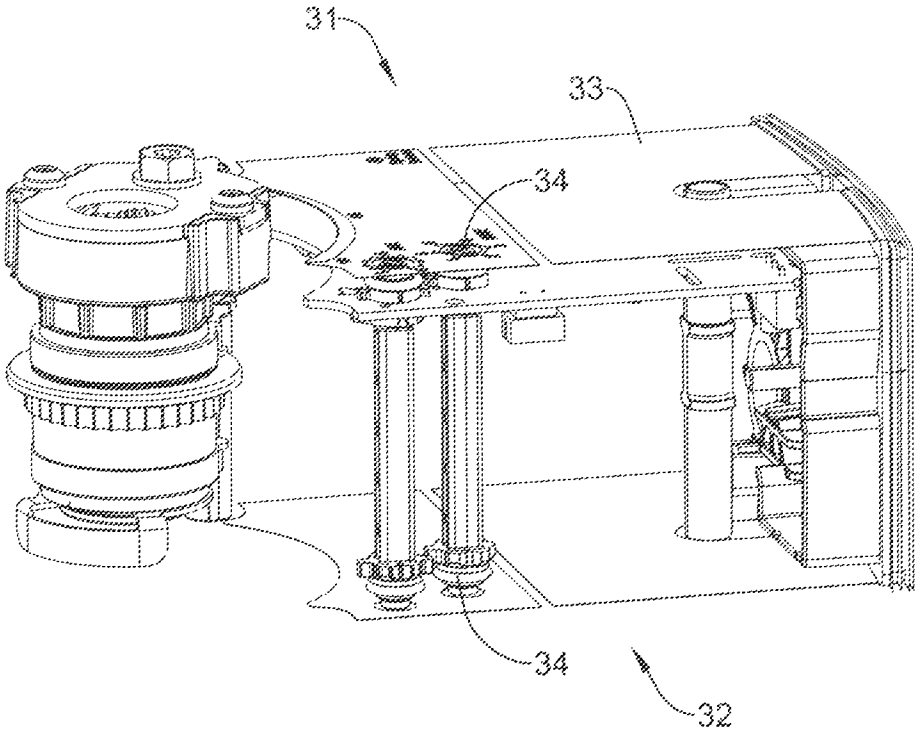
FIG. 6 is a diagram that shows perspective views of two sides of an actuator revealing the reversibility of actuator position for access to a selector from two sides of the actuator.

FIG. 6 is a diagram that shows perspective views of sides 31 and 32 of actuator 33 revealing the reversibility of the actuator for access to selector 34 from both sides of actuator 33.

The present approach may incorporate an actuator which has accessible onboard diagnostics. An issue in the related art may be that actuators in the field can fail or malfunction and of which many cases may be undetected. Such actuators may be wasting energy or giving up comfort for years before the failure is found.

The present approach may solve this issue by communicating alarms, status and diagnostics automatically over a bus. If an actuator fails, an alarm may be sent to the higher order controller for immediate notification. These software alarms and diagnostic features may be implemented in the firmware for a Sylk Zelix communicating actuator.

A controller or processor may provide on the communications bus one or more diagnostics items of a group consisting of high temperature warning, excessive noise on power line, record/report back electromotive force (EMF) on spring return, percentage of life detection, high amount of travel for given amount of time, hunting around a given point, actuator angle, communication normal indicator, stroke limiting, control valve (Cv) selection, flowrate on pressure independent control valve (PIC-V), set auxiliary switch, report auxiliary switch setting, report auxiliary switch status, report auxiliary switch current draw—auxiliary equipment status, if switch drives fan—verify fan shuts down before damper closes, if switch drives coils—verify heat exchanger running before opening/closing valve, report stuck valve/damper, PIC-V constant pressure—constant torque, changeover valve—no cycling for a period of time, time since last movement, date/time of first operation (commissioning), audible/detectable signal for location, device in warranty, device model number/serial number/date code, device type—outside air damper/standard ball valve/PIC-V valve/mixed air damper, actuator fitness/self-test routine—known system conditions, sensor—actual damper/valve position, super capacitor status, and energy consumption.

The present approach may incorporate an actuator test mode. There may be several approaches used by an actuator installer to verify that an actuator has been installed correctly. One approach may involve an operator at the control panel to cause the actuator to open and close. In another approach, the installer or maintainer may have access the connector and short the modulating input to cause the actuator to open, thus verifying that the actuator is working and connected properly.

With the test mode, there may be a test mode selection on a pot or switch that causes the actuator to move to its open position. An installer or maintainer may then just select Test Mode via the pot and verify an operation of the actuator without needing to access the connector or to communicate with a control operator.

Actuator software may verify that the test mode has been selected on the switch or potentiometer. The software may then exercise the following algorithm.

IF Test Mode THEN

Set actuator speed to maximum allowable speed

Cause actuator to open (move to end of its allowable span)

Remain in this position while in Test Mode.

Figure 7:
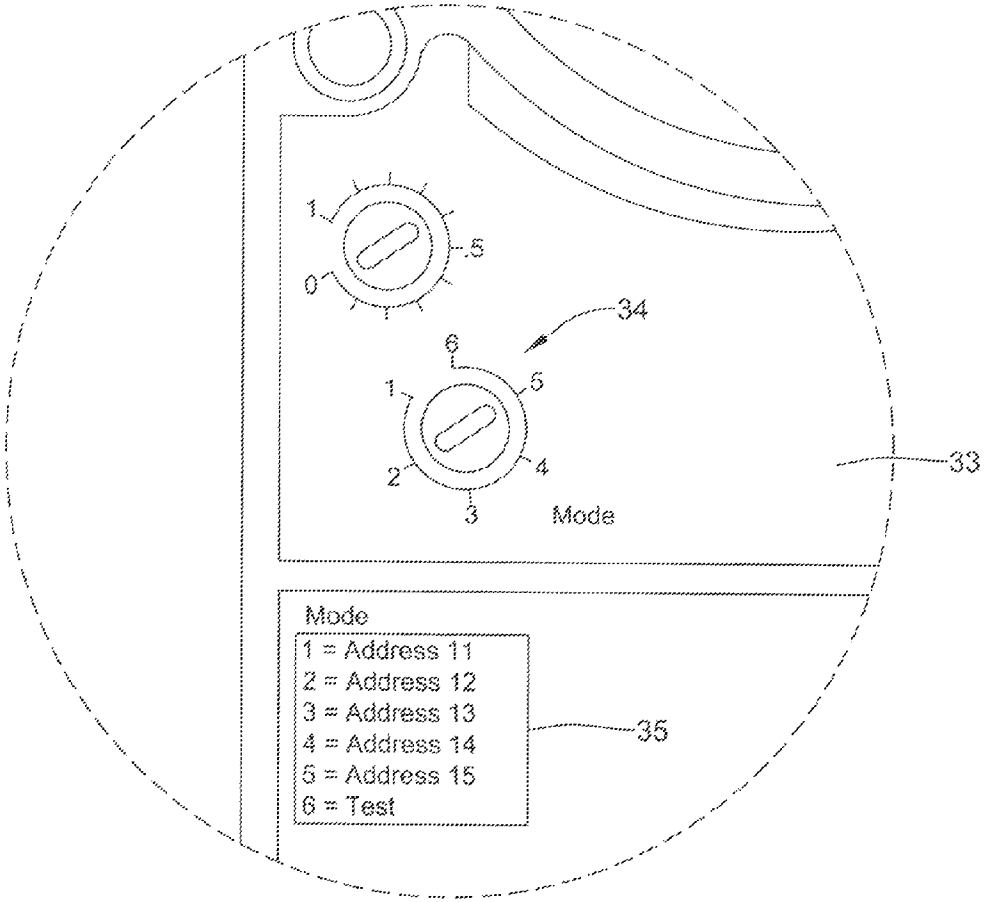
FIG. 7 is a diagram of a close view of a selector or mode switch showing positions available for a test mode and addresses of an actuator.

FIG. 7 is a diagram of a closer view of the selector or mode switch 34, showing 6 positions available for the test mode of actuator 33. A mode plate 35 indicates that position 6 may be designated for "Test" or test mode. Positions 1-5 indicate five different addresses available for selection by switch 34.

Figure 8:
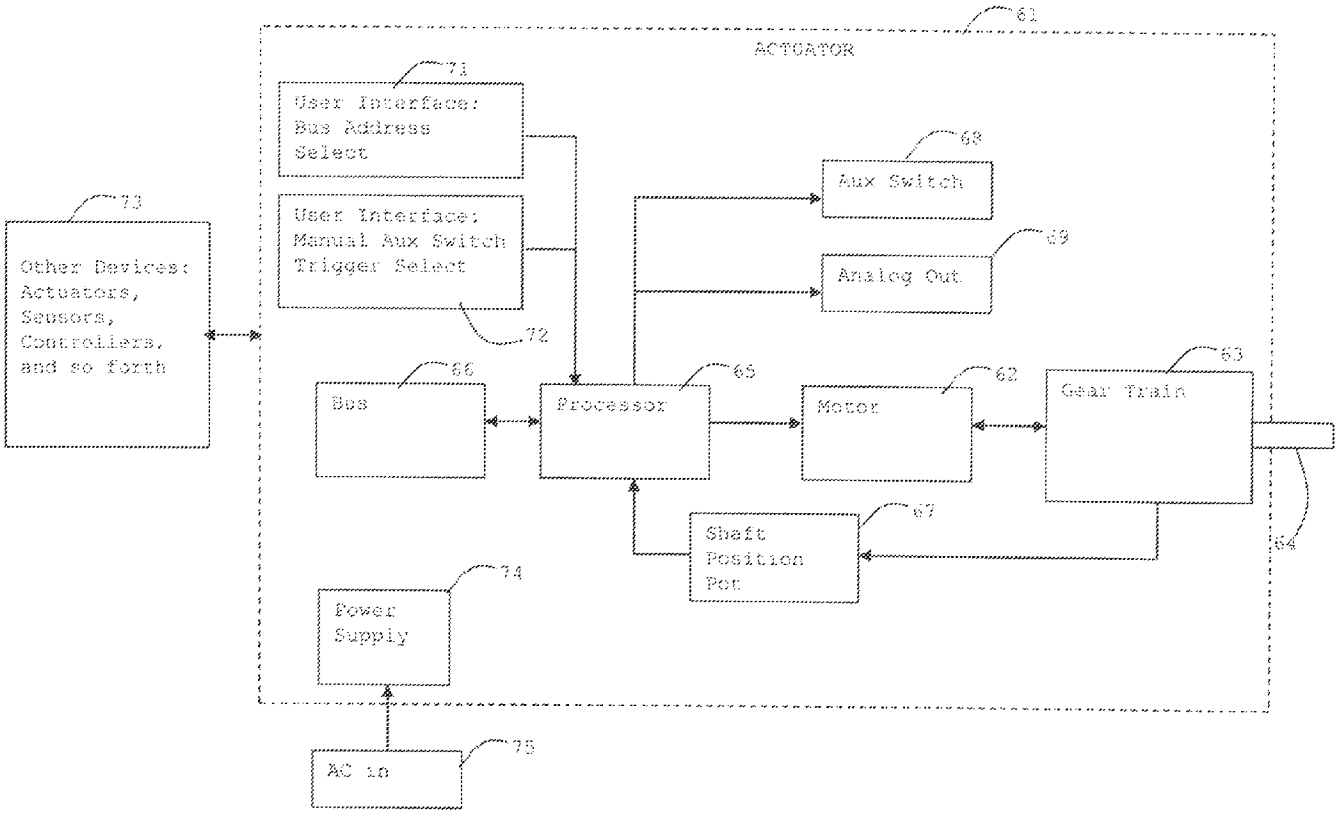
FIG. 8 is a diagram of a two-wire polarity-insensitive bus controlled actuator.

FIG. 8 is a diagram of a two-wire polarity-insensitive bus (i.e., Sylk) controlled actuator 61. An electric motor 62 may drive a gear train 63 which turn an actuator shaft 64 which may move a damper, valve, or other component. A processor 65 may be connected to motor 62 and provide control of the motor. Processor 65 may also be connected to a communications bus 66. A shaft position potentiometer 67 may be mechanically connected to the actuator shaft 64 or a part on the gear train to electrically provide a position of shaft 64 to processor 65. An auxiliary switch output 68 and an analog output 69 may be provided by processor 65. A user interface 71 may provide a bus address select to processor 65. A user interface 72 may provide a manual auxiliary switch trigger select. Actuator 61 may be connected to other devices 73 such as actuators, sensors, controllers, and so on. Actuator 61 may have a power supply 74 to power its components. An AC power line 75 or other source may provide power to supply 74.

Figure 9:
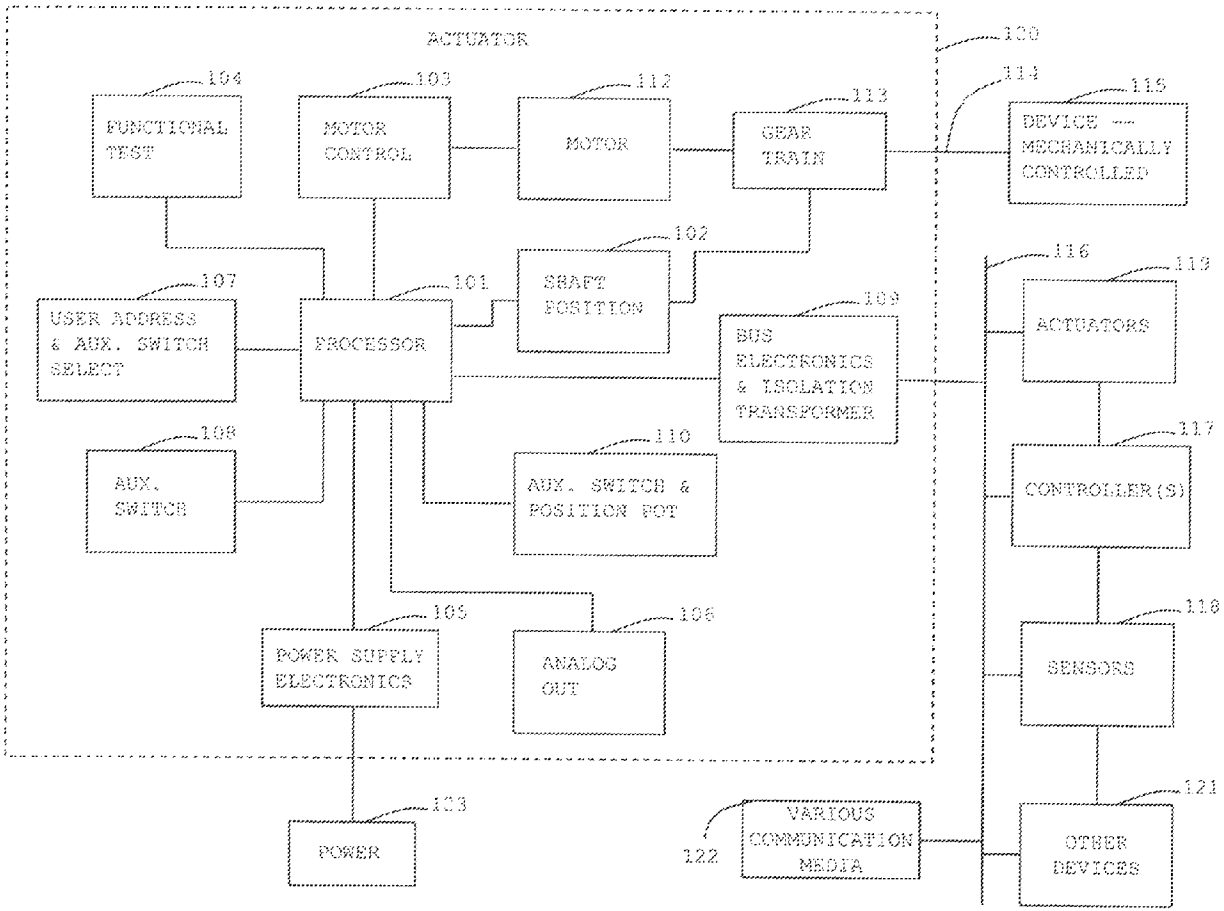
FIG. 9 is diagram of another layout of another actuator.

FIG. 9 is a diagram of an actuator 120. Many components of actuator 120 are revealed in the diagrams shown in FIGS. 10*a* through 10*r*. Interconnections of the components may be indicated in the diagrams as identified by various connections and wires having labels and alphanumeric symbols. For example, a line identified as A1 in FIG. 10*a* may be connected to a line identified as A1 in FIG. 10*b*. A processor 101 may be connected to power supply electronics 105, bus electronics and isolation transformer 109, a motor control 103 and a shaft position indicator 102. Processor 101 may also be connected to an auxiliary switch 108, an auxiliary switch and position potentiometer 110, and a user address and auxiliary switch selector 107. Further, processor 101 may be connected to an analog out 106 and functional test electronics 104.

A motor 112 may be connected to motor control 103. An output of motor 112 may be mechanically connected to a gear reduction train 113. Gear train 113 may have an actuator coupling or shaft 114 for connection to a mechanically controlled or operated device 115 such as, for example, a damper, valve, flap, louver, and so on. Gear train 113 may be connected to shaft position indicator 102.

Bus electronics and isolation transformer 109 may be connected to a communications bus 116. Outside actuator 120, bus 116 may be connected to controllers 117, sensors 118, actuators 119, and other devices 121 and various communication media 122. An outside power source 123 may be connected to power supply electronics.

Figure 10A:
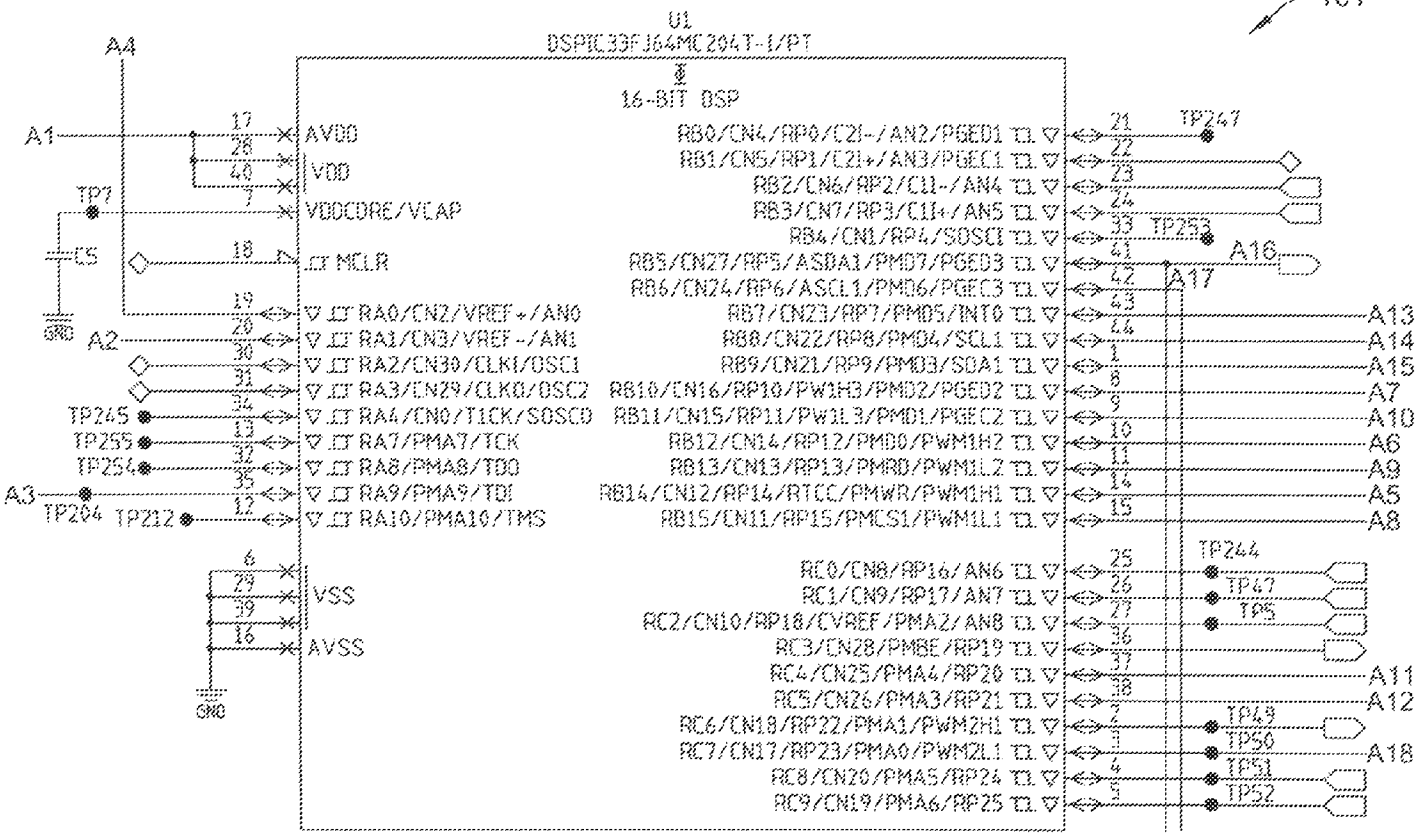
FIGS. 10*a* through 10*r* are schematics of circuitry for the actuator as represented by FIG. 9.
Figure 10B:
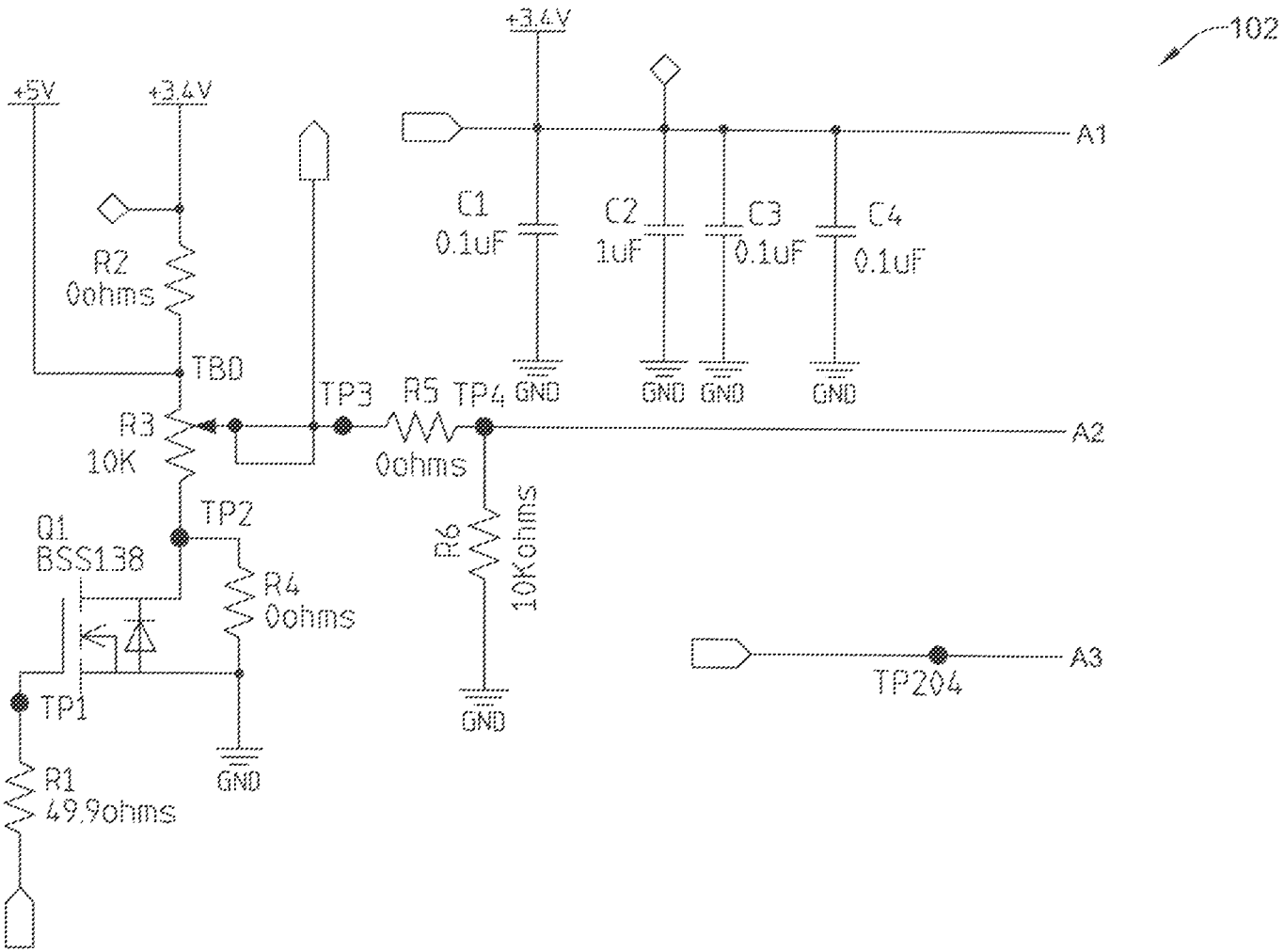
Figure 10C:
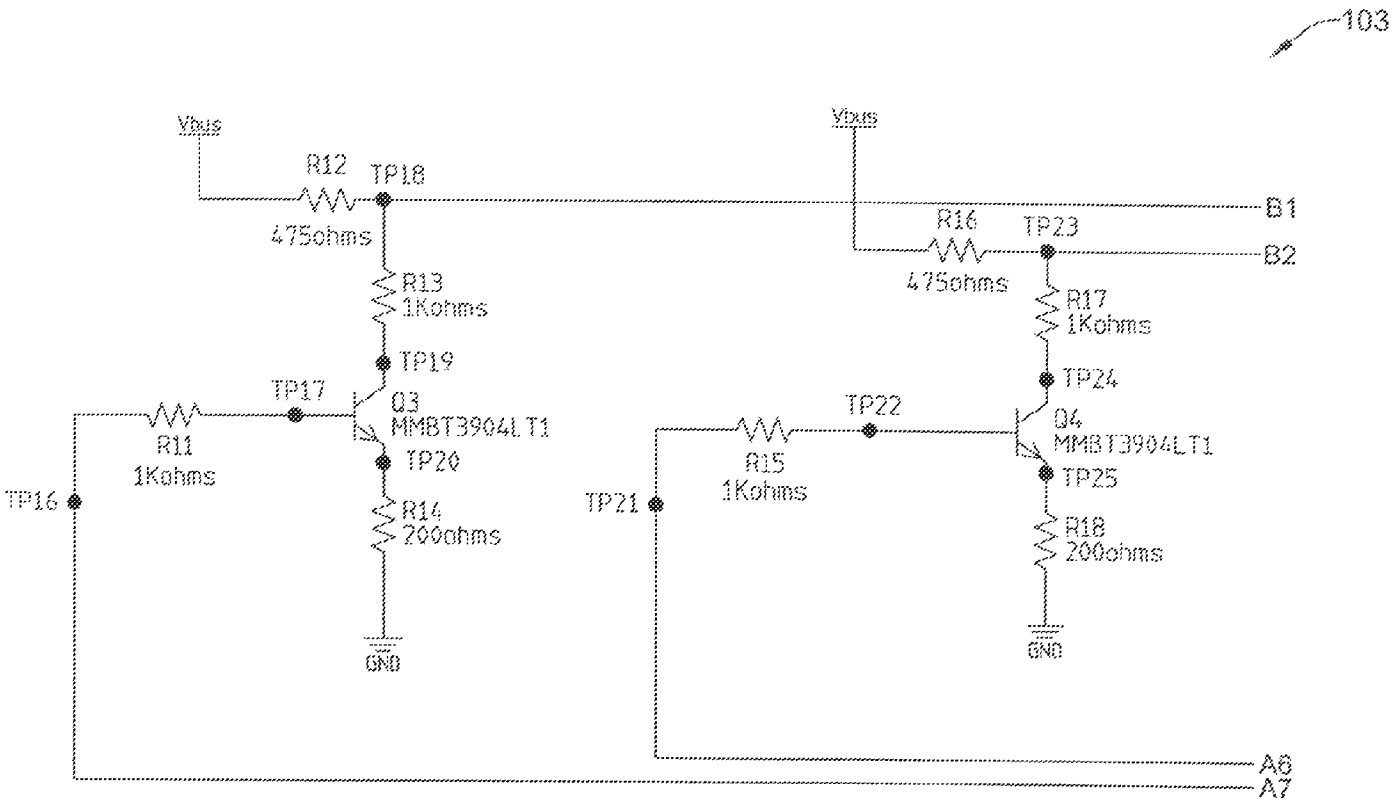
Figure 10D:
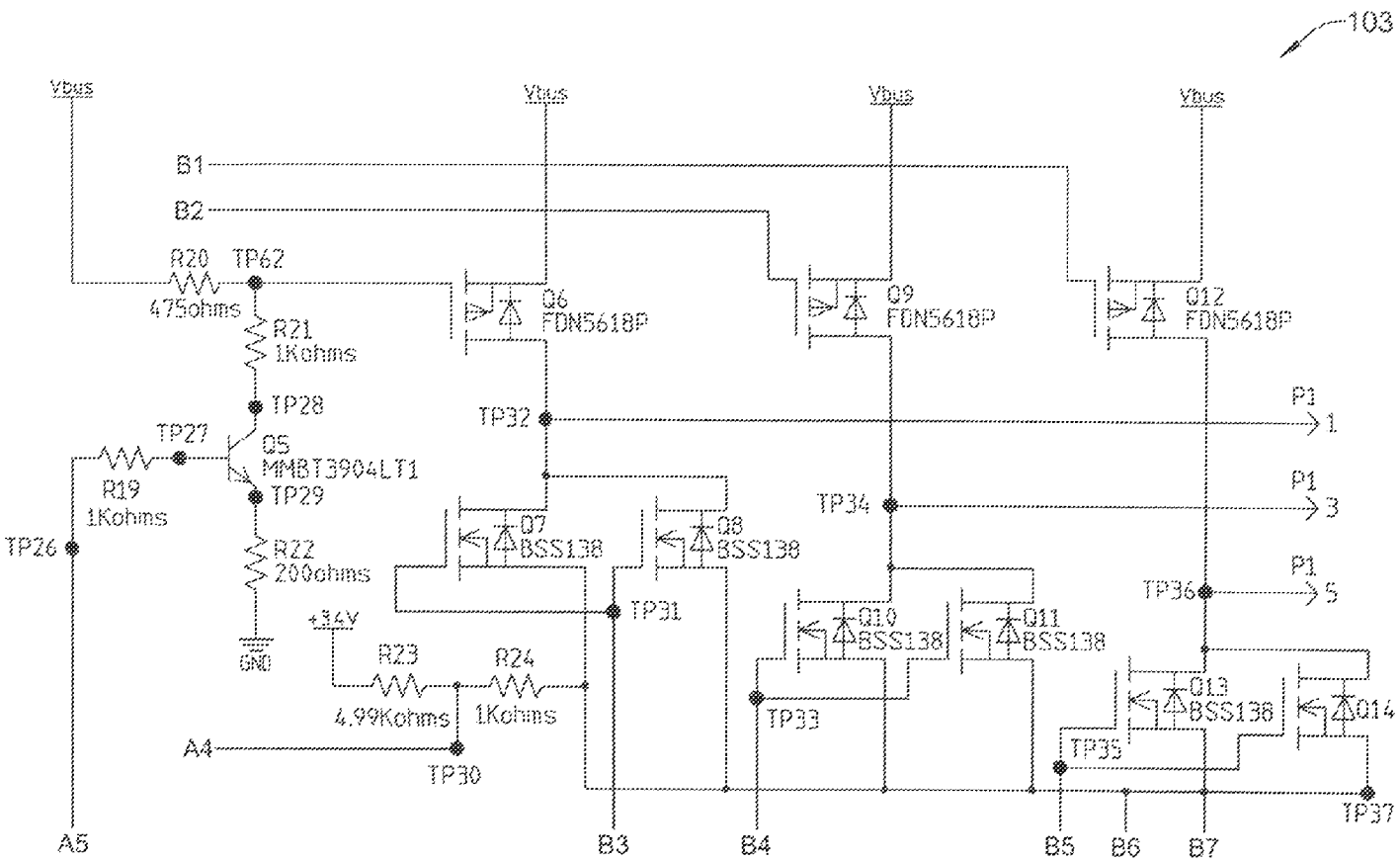
Figure 10C:
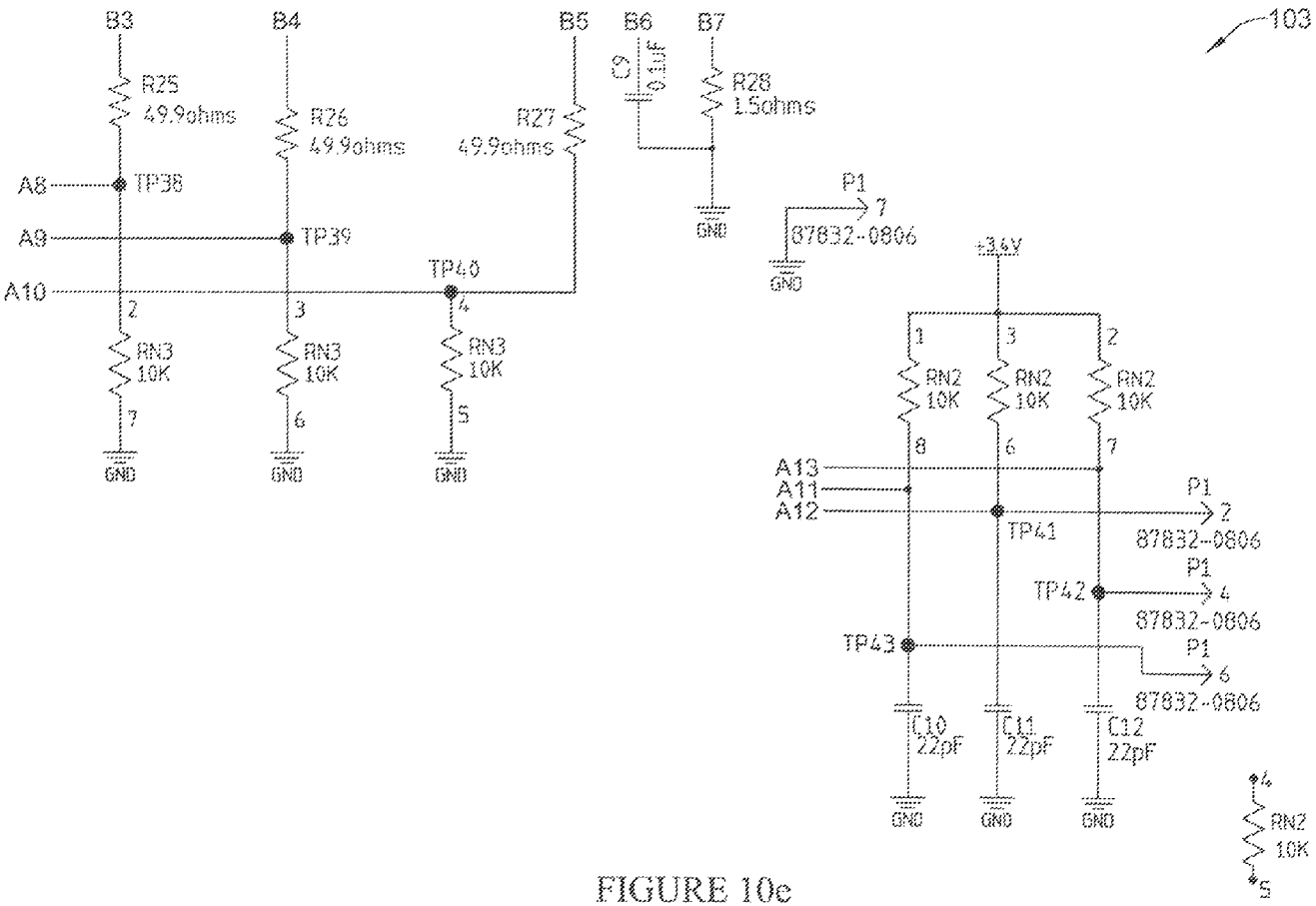
Figure 10F:
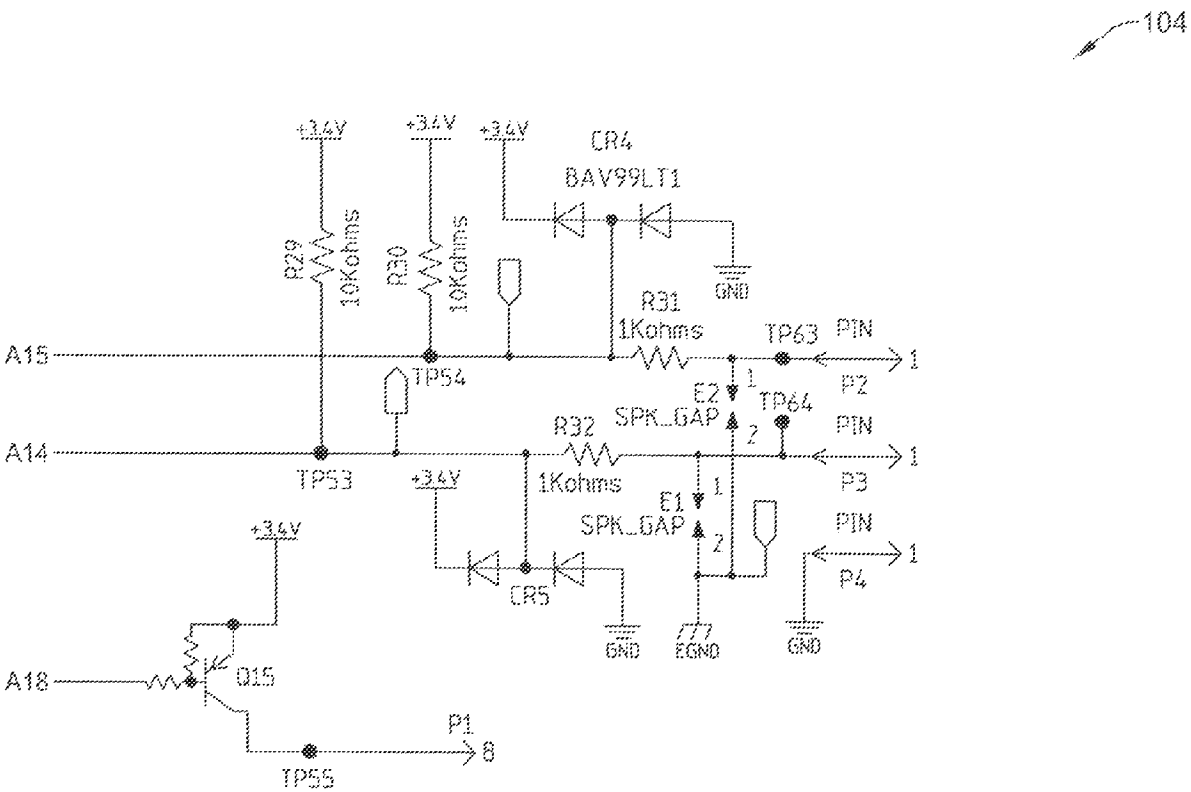
Figure 10G:
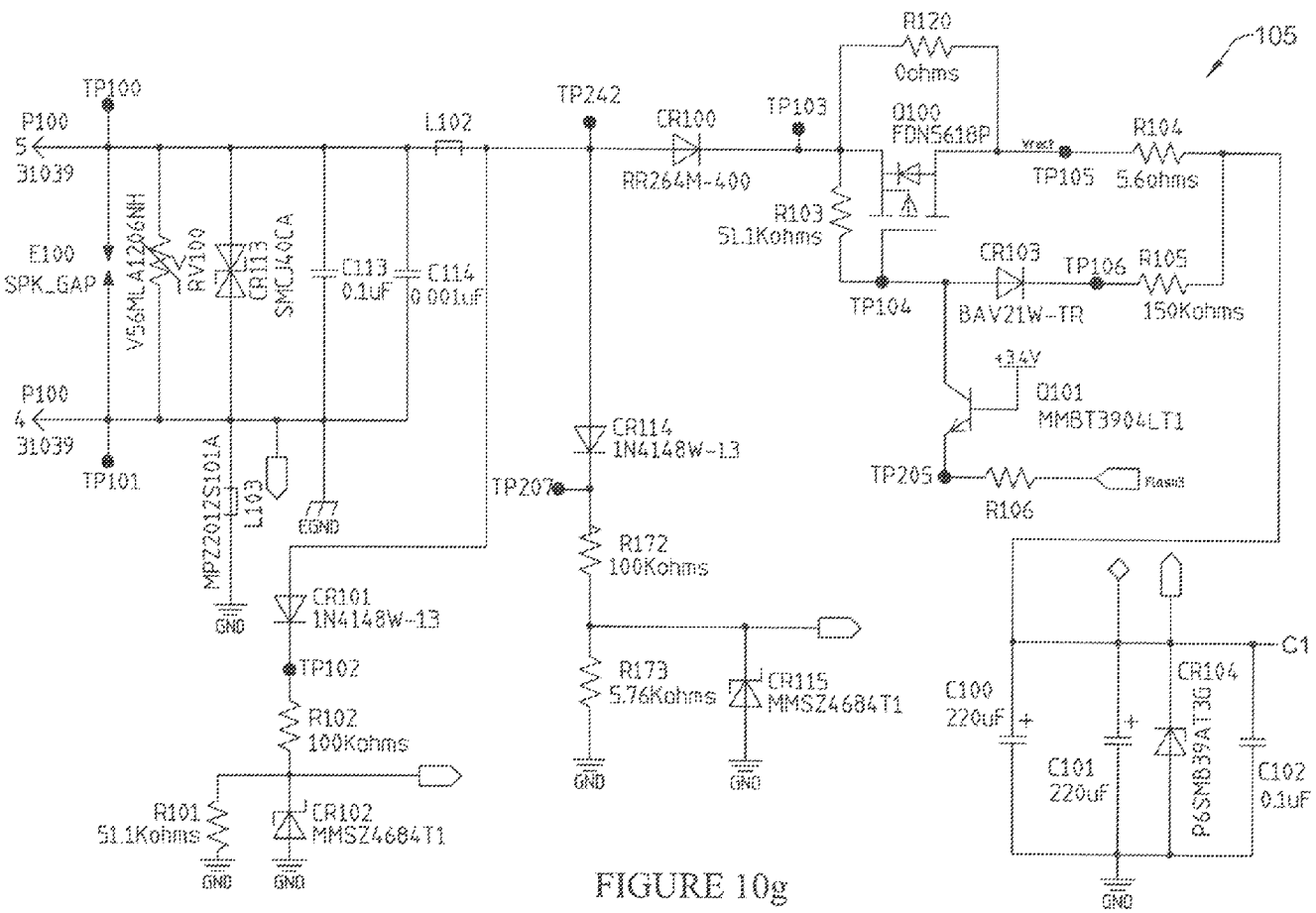
Figure 10H:
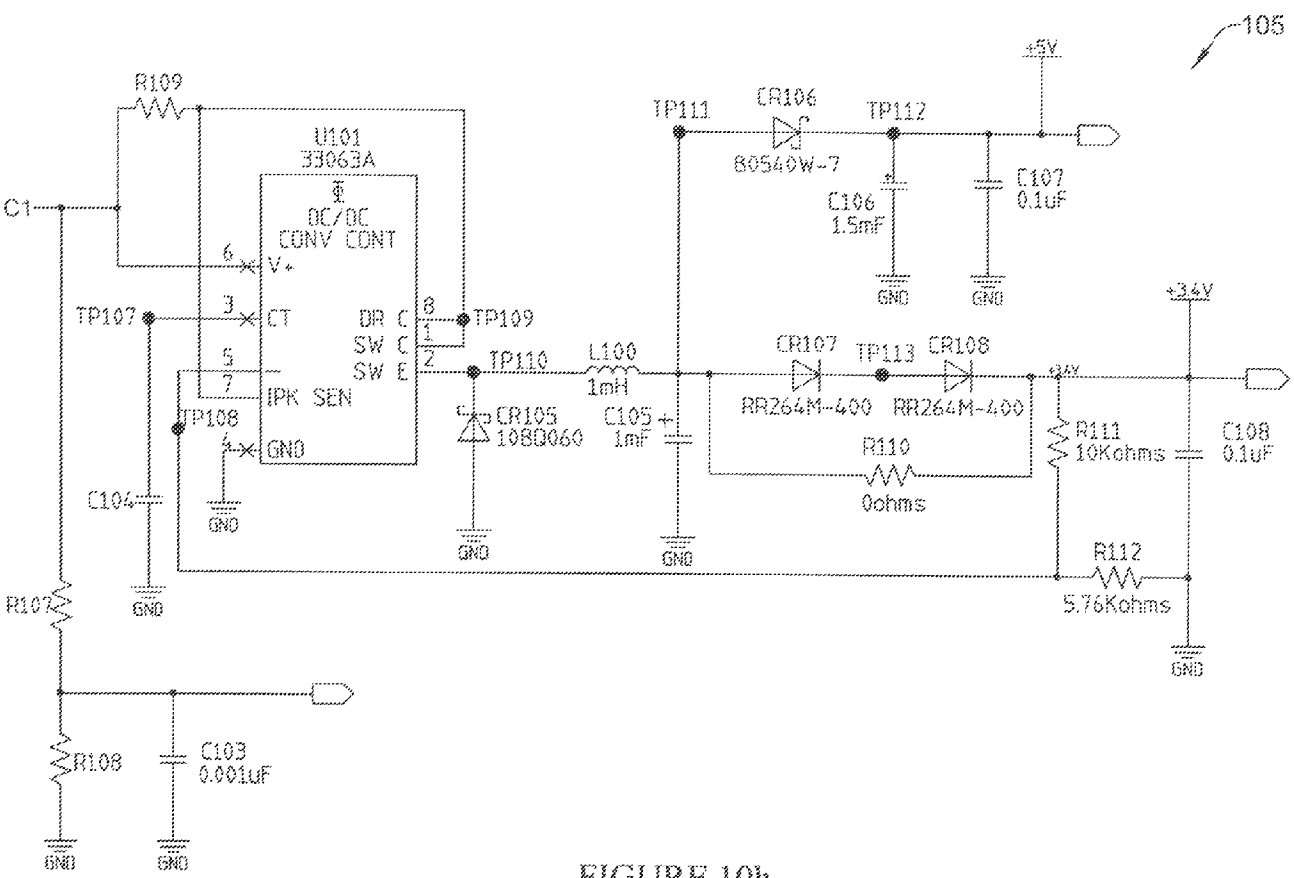
Figure 10I:
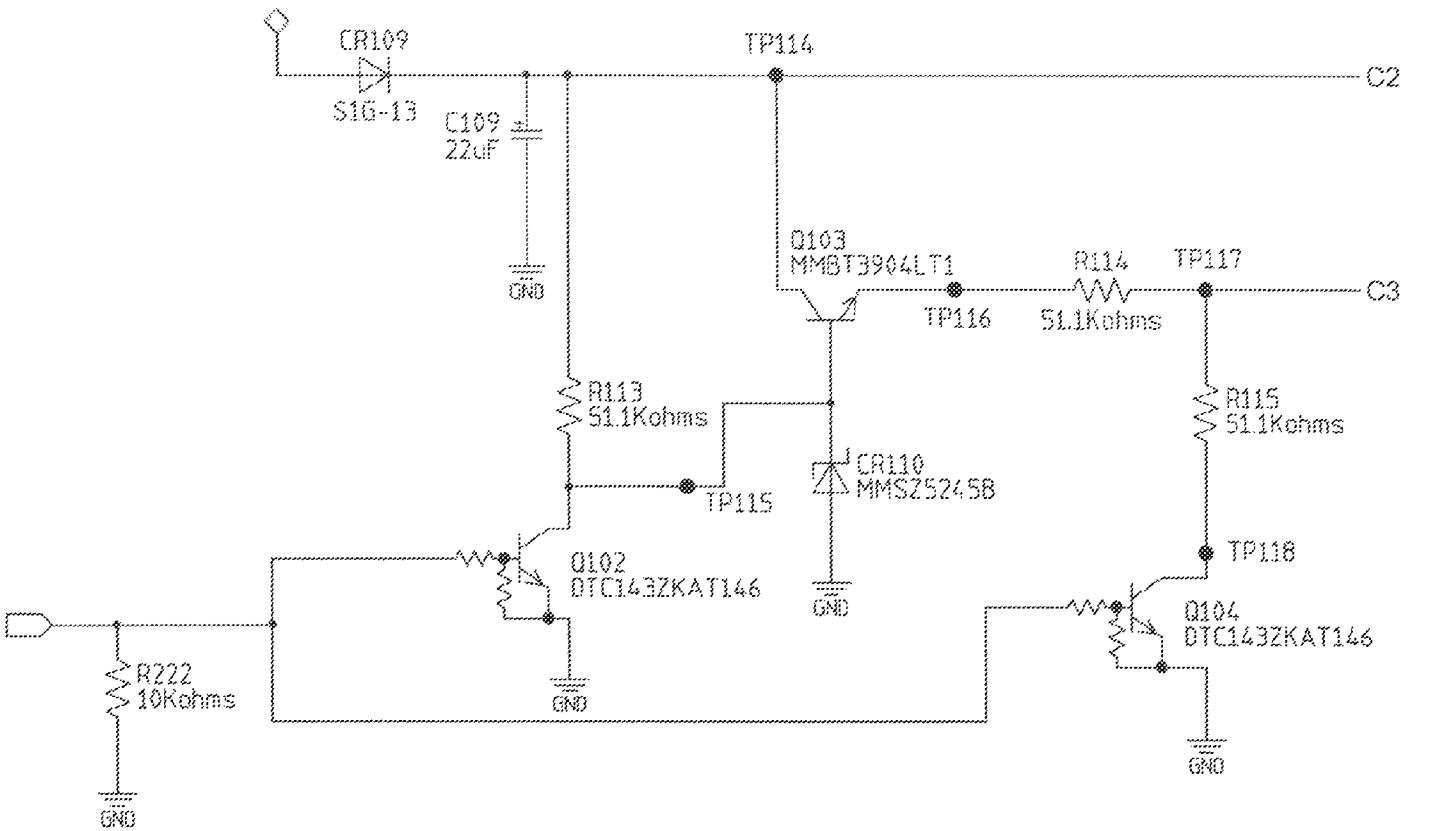
Figure 10J:
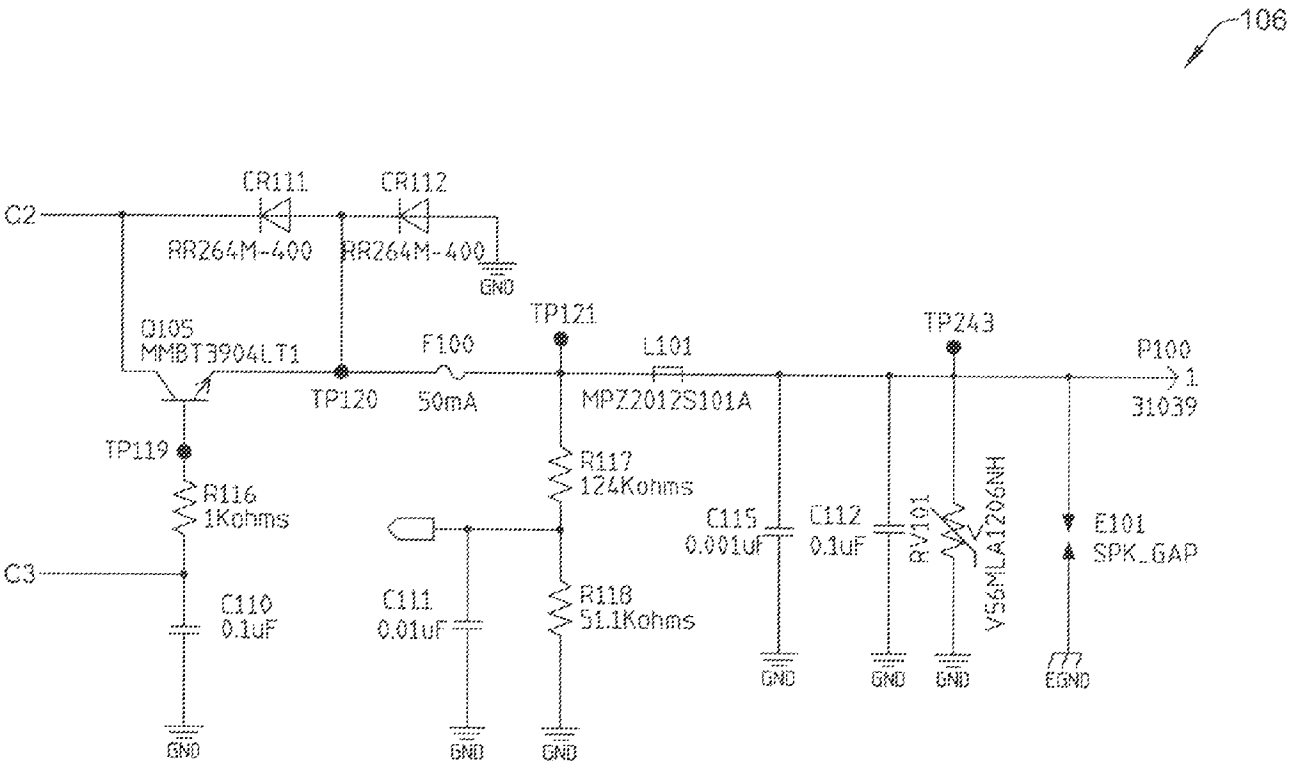
Figure 10K:
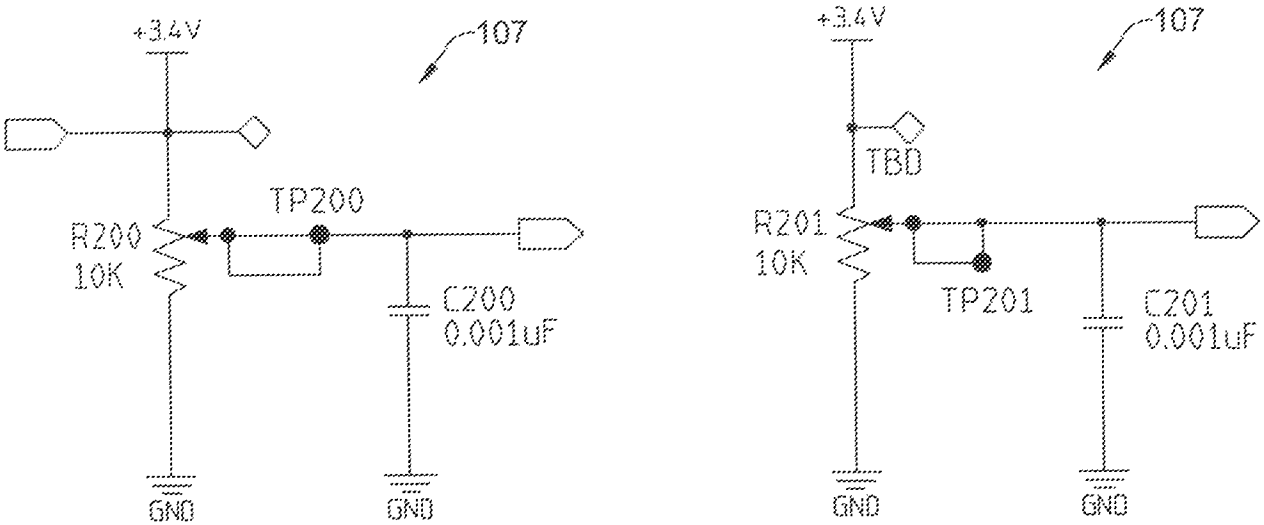
Figure 101:
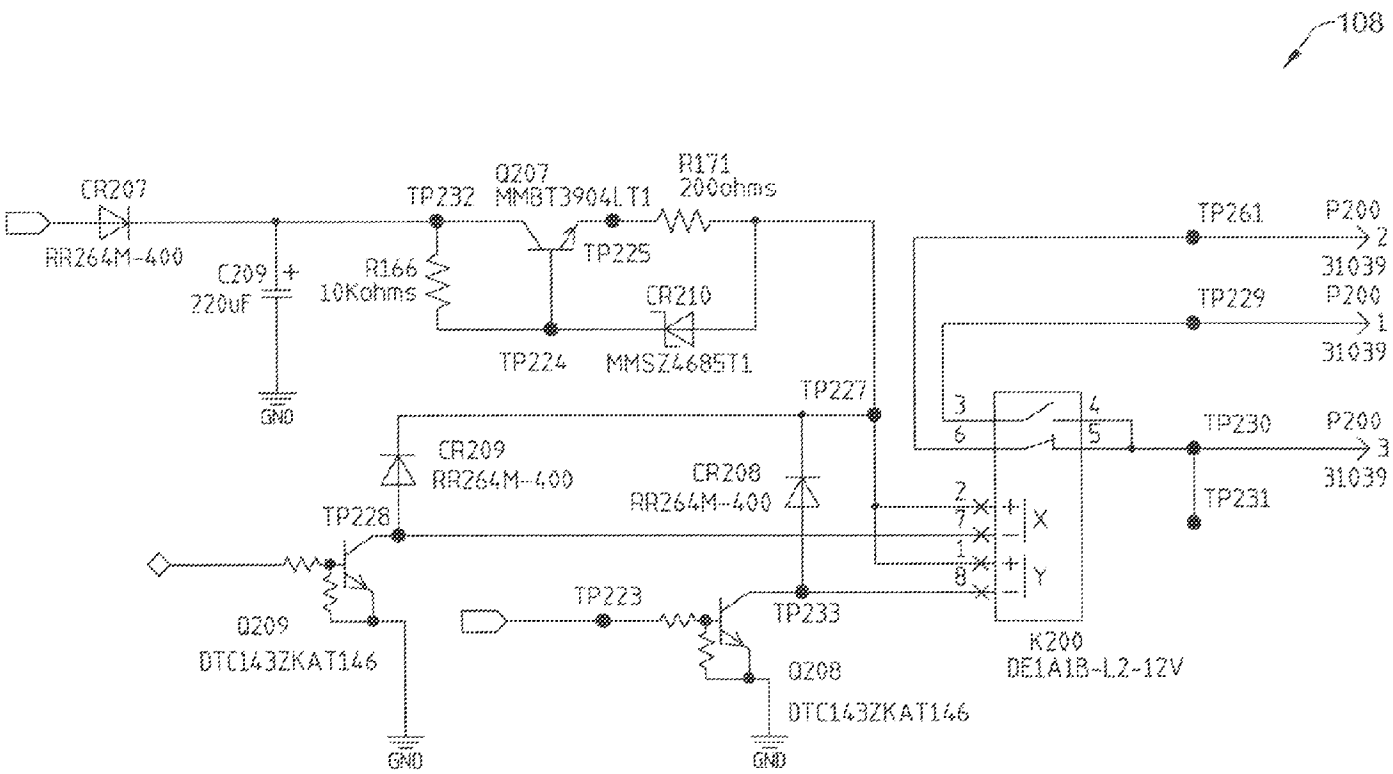
Figure 10M:
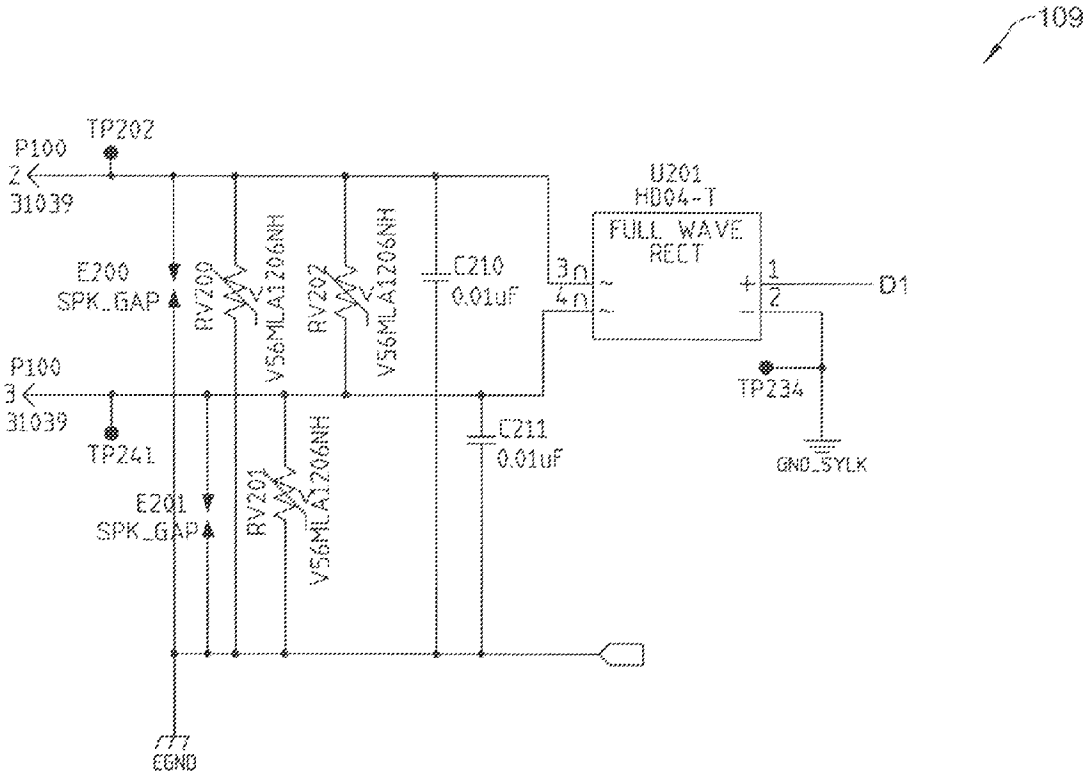
Figure 10N:
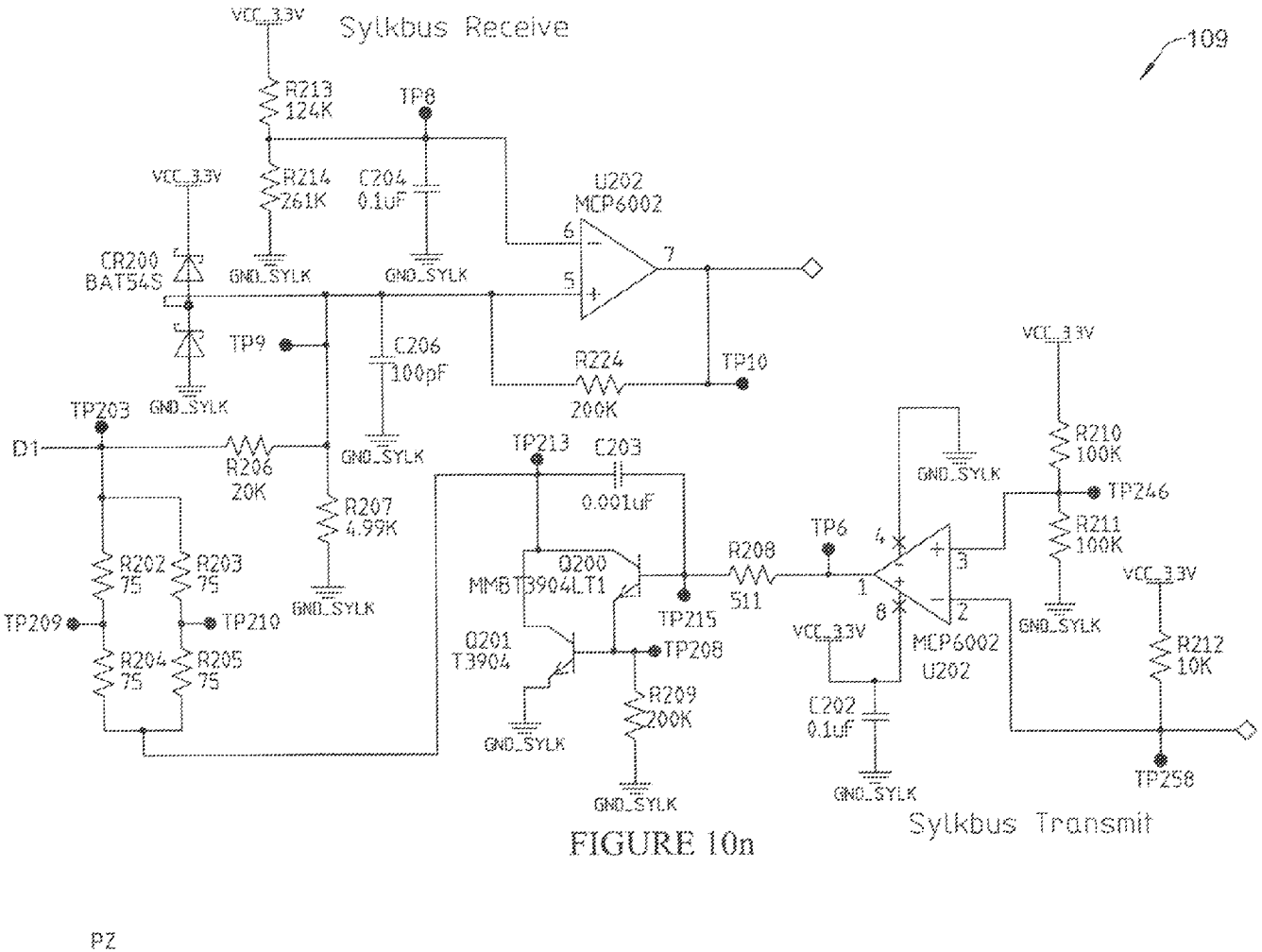
Figure 10O:
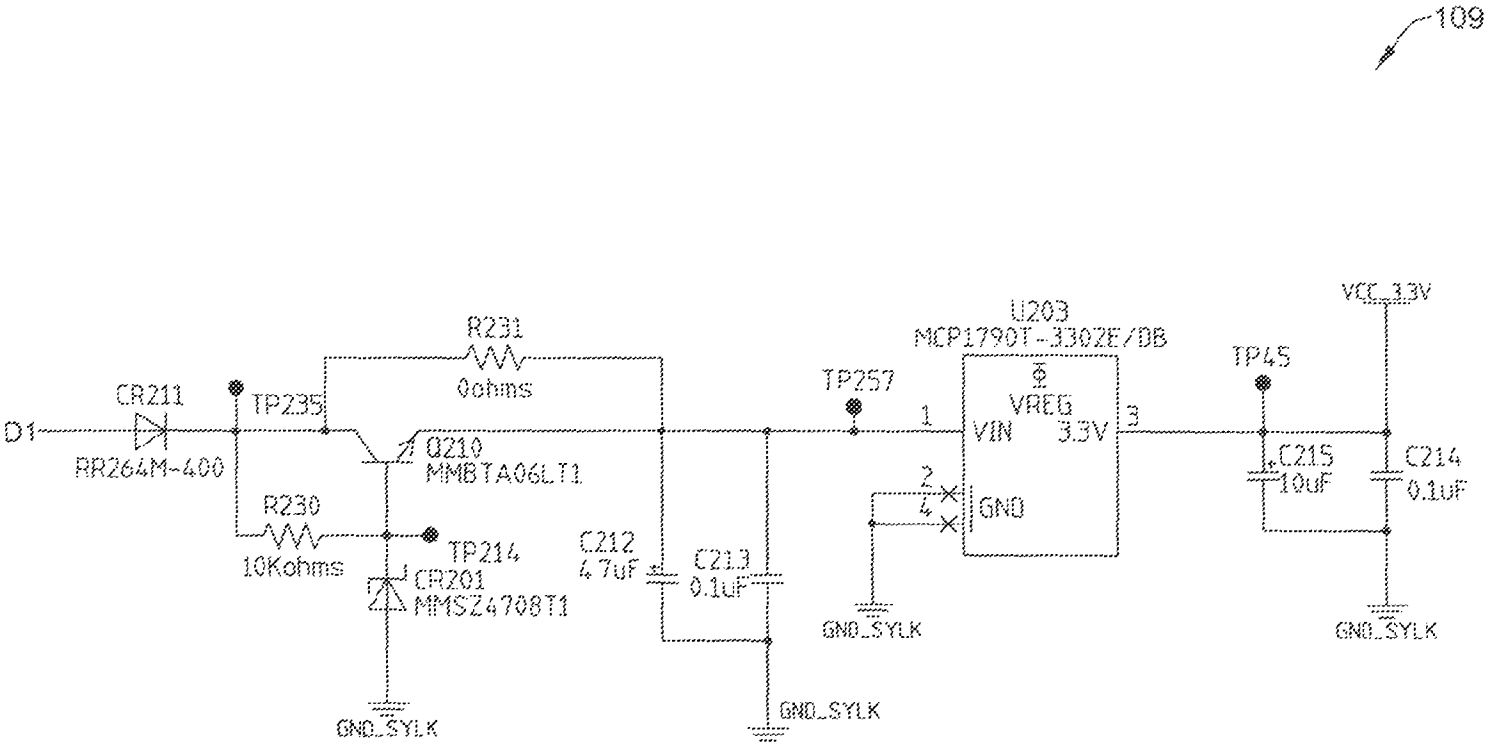
Figure 10P:
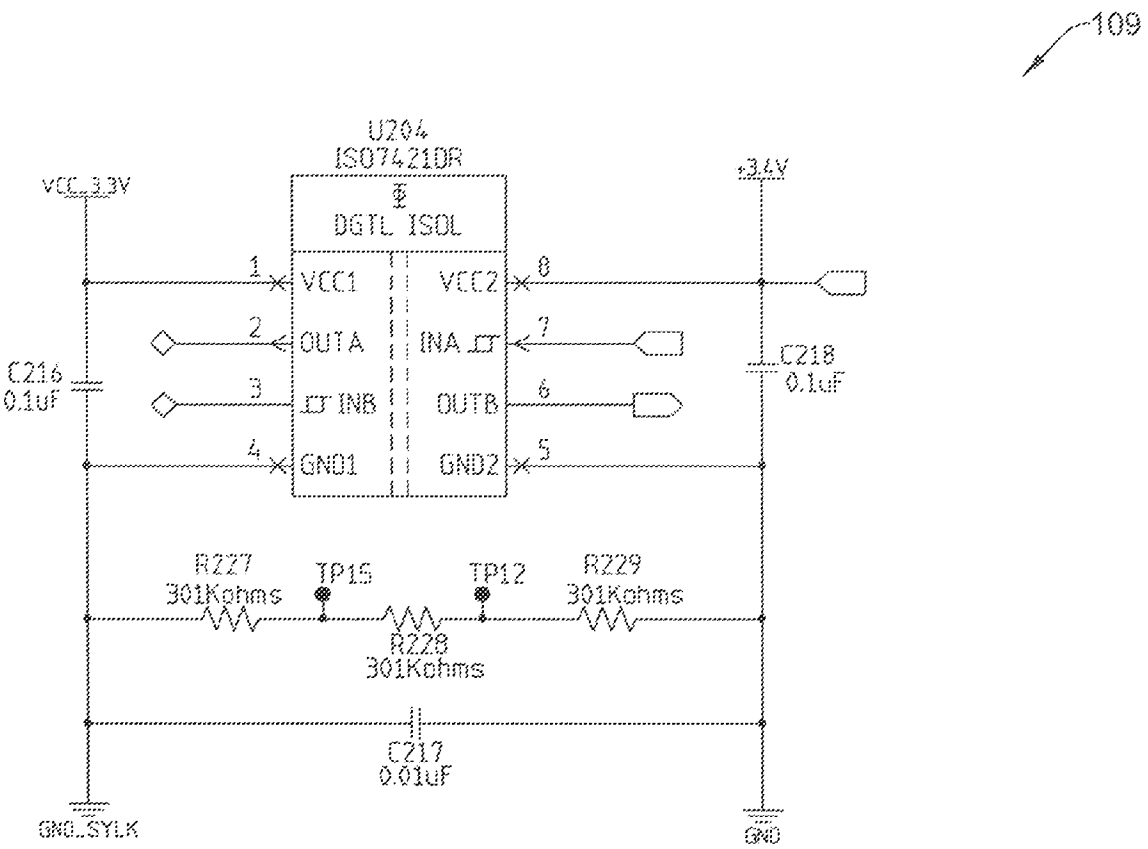
Figure 10Q:
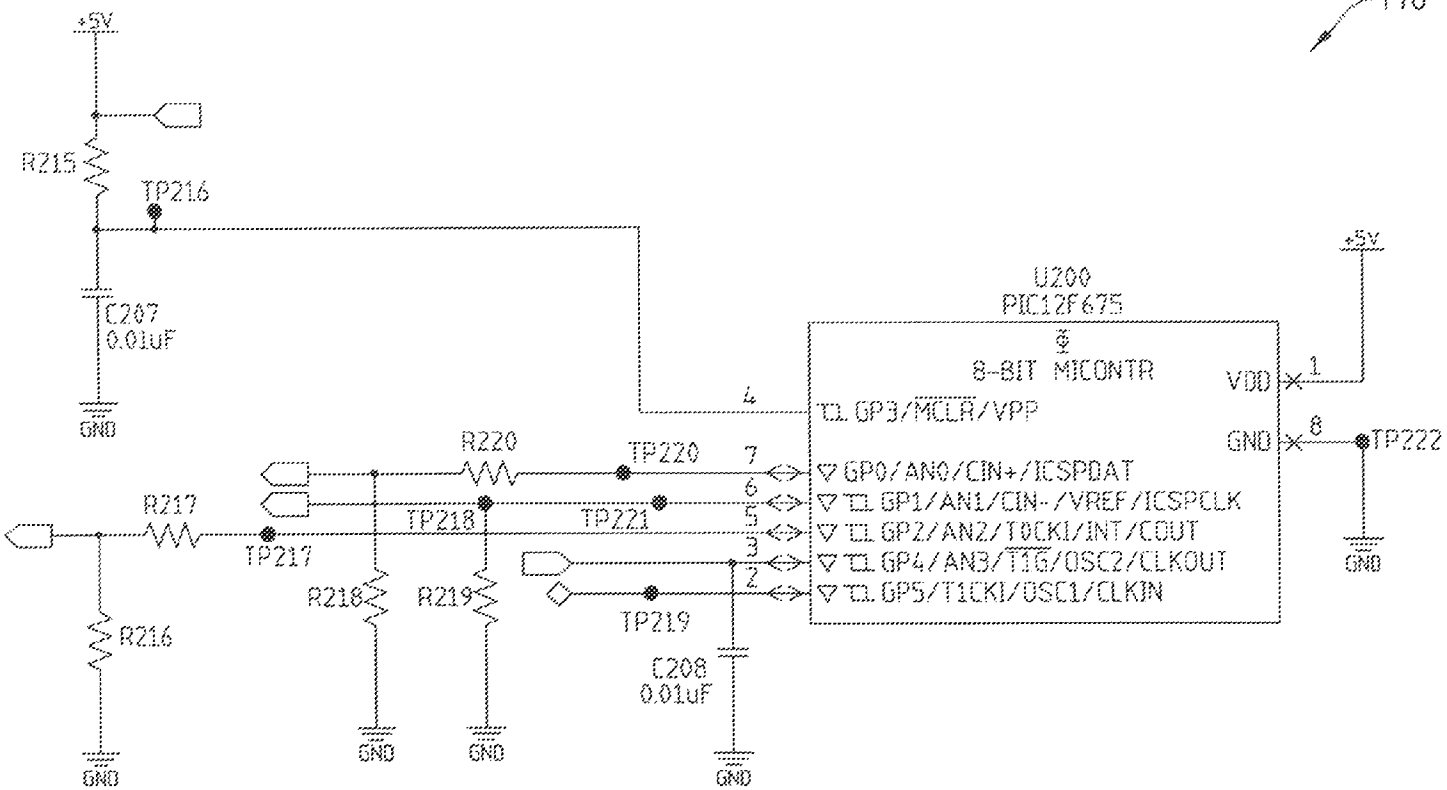
Figure 10R:
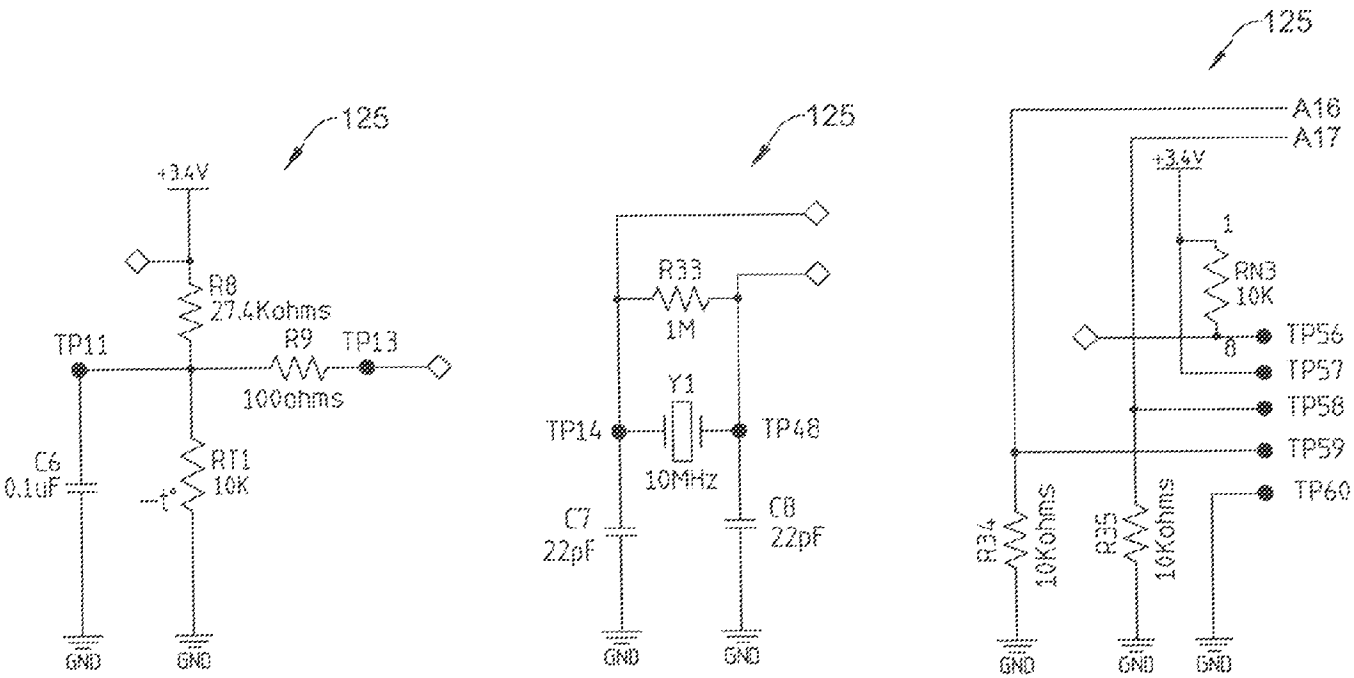

Processor 101 may be shown in a' diagram of FIG. 10*a*. Shaft position indicator 102 may be shown in a diagram of FIG. 10*b*. Motor control 103 may be shown in diagrams of FIGS. 10*c*, 10*d* and 10*e*. Functional test electronics may be shown in a diagram of FIG. 10*f*. Power supply electronics may be shown in diagrams of FIGS. 10 *g* and 10*h*. Analog out electronics 106 may be shown in diagrams of FIGS. 10*i*, and 10*j*. User address and auxiliary switch circuitry 107 may be shown in diagrams of FIG. 10*k*. Auxiliary switch circuitry 108 may be shown in a diagram of FIG. 101. Communications bus electronics 109 may be shown in diagrams of FIGS. 10*m*, 10*n*, 10*o* and 10*p*. Auxiliary switch and position potentiometer circuitry 110 may be shown in a diagram of FIG. 10*q*. Miscellaneous circuitry 125, such as thermistor, oscillator and flash electronics may be in diagrams of FIG. 10*r*. Some of the other Figures noted herein may show diagrams of other portions of circuitry helpful in building the actuator system.

The following is a recap of the present actuator system. An actuator system for use with heating, ventilating and air conditioning (HVAC) equipment, may incorporate an HVAC actuator. The actuator may have a motor, a motor controller connected to the motor, a processor connected to the motor controller, and a coupling for a shaft connection attached to an output of the motor.

The processor may incorporate a diagnostics program, and be Connected to a communications bus. Diagnostic results of the diagnostics program may be communicated from the processor over the communications bus to a system controller. If the diagnostic results communicated from the processor over the communications bus to the system controller indicate an insufficiency of the actuator, then an alarm identifying the insufficiency may be communicated over the communications bus to the system controller. The communications bus may consist of two polarity-insensitive wires.

If the motor and/or the motor controller fails, then an alarm may be sent to the system controller as an immediate notification of an actuator failure. The processor may indicate a status of active or inactive of the actuator on the communications bus. If the status is indicated as inactive, then a condition of whether the actuator is operable or inoperable may be determined. The system controller may identify an actuator as communicating diagnostic results according to an address of the actuator. The system controller may be an economizer.

An actuator system for use with heating, ventilating and air conditioning equipment, may incorporate an HVAC actuator. The actuator may incorporate a motor, a gear train mechanically connected to the motor, an actuator shaft mechanically connected to the gear train, a shaft position indicator connected to the actuator shaft, and a processor connected to the motor and the shaft position indicator. The processor may have a diagnostics program, and be connected to a communications bus.

The actuator may further incorporate a current sensor and a voltage sensor connected to the motor and the processor. The processor may determine immediate power consumption of the actuator from current and voltage indications from the current sensor and voltage sensor, respectively. The processor may also provide an excessive power alarm if the immediate power consumption exceeds a predetermined percentage over a given amount of measured power consumption by the motor considered to be during normal operation of the actuator, and may provide an insufficient power alarm if the immediate power consumption is less than a predetermined percentage under a given amount of measured power consumption by the motor considered to be during normal operation of the actuator.

If the actuator fails, the processor may send an actuator failure alarm via the communications bus as an immediate notification to a system controller. The processor may provide alarms, status and diagnostics of the actuator automatically over the communications bus. The communications bus may have two polarity-insensitive wires.

The processor may also provide on the communications bus one or more diagnostics items of a group consisting of high temperature warning, excessive noise on power line, record/report back electromotive force (EMF) on spring return, percentage of life detection, high amount of travel for given amount of time, hunting around a given point, actuator angle, communication normal indicator, stroke limiting, control valve (Cv) selection, flowrate on pressure independent control valve (PIC-V), set auxiliary switch, report auxiliary switch setting, report auxiliary switch status, report auxiliary switch current draw—auxiliary equipment status, if switch drives fan—verify fan shuts down before damper closes, if switch drives coils—verify heat exchanger running before opening/closing valve, report stuck valve/damper, PIC-V constant pressure—constant torque, changeover valve—no cycling for a period of time, time since last movement, date/time of first operation (commissioning), audible/detectable signal for location, device in warranty, device model number/serial number/date code, device type—outside air damper/standard ball valve/PIC-V valve/mixed air damper, actuator fitness/self-test routine—known system conditions, sensor—actual damper/valve, position, super capacitor status, and energy consumption.

An approach for attaining diagnostics of an actuator for use in heating, ventilating and air conditioning (HVAC), may incorporate entering a diagnostics program for an HVAC actuator into a processor of the actuator, transmitting results of the diagnostics program on a communications bus, and reviewing the results from the communications bus. The diagnostics program having alarms and diagnostic characteristics may be implemented in firmware of the processor.

The actuator may have a motor, a gear train connected to the motor, an actuator shaft coupling connected to the gear train, a shaft position indicator connected to the actuator shaft coupling and to the processor, and one or more sensors situated at the actuator and connected to the processor.

The approach may further incorporate sending an alarm via the processor to a controller via the communications bus if the actuator shaft coupling fails to move upon transmitting signals to the processor commanding a movement of the motor. The communications bus may be a two-wire polarity-insensitive bus which can convey signals and power.

Two or more actuators and the controller may be connected to the communications bus. The controller may be an economizer. A processor may provide on the communications bus one or more actuator related items of a group consisting of high temperature warning, excessive noise on power line, record/report back electromotive force (EMF) on spring return, percentage of life detection, high amount of travel for given amount of time, hunting around a given point, actuator angle, communication normal indicator, stroke limiting, control valve (Cv) selection, flowrate on pressure independent control valve (PIC-V), set auxiliary switch, report auxiliary switch setting, report auxiliary switch status, report auxiliary switch current draw—auxiliary equipment status, if switch drives fan—verify fan shuts down before damper closes, if switch drives coils—verify heat exchanger running before opening/closing valve, report stuck valve/damper, PIC-V constant pressure—constant torque, changeover valve—no cycling for a period of time, time since last movement, date/time of first operation (commissioning), audible/detectable signal for location, device in warranty, device model number/serial number/date code, device type—outside air damper/standard ball valve/PIC-V valve/mixed air damper, actuator fitness/self-test routine—known system conditions, sensor—actual damper/valve position, super capacitor status, and energy consumption.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. An actuator system for use with heating, ventilating and air conditioning (HVAC) equipment, comprising:
- an HVAC actuator; and
- wherein the actuator comprises:
  - a motor;
  - a motor controller connected to the motor;
  - a processor connected to the motor controller; and
  - a coupling for a shaft connection attached to an output of the motor; and
- wherein:
- the processor comprises a diagnostics program;
- the processor is connected to a communications bus;
- the processor indicates a status of active or inactive of the actuator on the communications bus;
- if the status is indicated as inactive, then a condition of whether the actuator is operable or inoperable is determined; and
- diagnostic results of the diagnostics program are communicated from the processor over the communications bus to a system controller.

2. The actuator system of claim 1, wherein if the diagnostic results communicated from the processor over the communications bus to the system controller indicate an insufficiency of the actuator, then an alarm identifying the insufficiency is communicated over the communications bus to the system controller.

3. The actuator system of claim 2, wherein the communications bus comprises two polarity-insensitive wires.

4. The actuator system of claim 1, wherein if the motor and/or the motor controller fails, then an alarm is sent to the system controller as an immediate notification of an actuator failure.

5. The actuator of claim 1, wherein:
- the system controller identifies an actuator as communicating diagnostic results according to an address of the actuator; and
- the system controller is an economizer.

6. An actuator system for use with heating, ventilating and air conditioning equipment (HVAC), comprising:
- an HVAC actuator; and
- wherein the actuator comprises:
  - a motor;
  - a gear train mechanically connected to the motor;
  - an actuator shaft mechanically connected to the gear train;
  - a shaft position indicator connected to the actuator shaft; and
  - a processor connected to the motor and the shaft position indicator;
  - a current sensor connected to the motor and the processor;
  - a voltage sensor connected to the motor and the processor; and
  - wherein the processor comprises a diagnostics program.

7. The system of claim 6, wherein the processor is connected to a communications bus.

8. The system of claim 6, wherein:

the processor determines immediate power consumption of the actuator from current and voltage indications from the current sensor and voltage sensor, respectively;

the processor provides an excessive power alarm if the immediate power consumption exceeds a predetermined percentage over a given amount of measured power consumption by the motor considered to be during normal operation of the actuator; and the processor provides an insufficient power alarm if the immediate power consumption is less than a predetermined percentage under a given amount of measured power consumption by the motor considered to be during normal operation of the actuator.

9. The actuator system of claim 6, wherein if the actuator fails, the processor sends an actuator failure alarm via a communications bus as an immediate notification to a system controller.

10. The actuator system of claim 9, wherein the communications bus comprises two polarity-insensitive wires.

11. The actuator system of claim 6, wherein the processor provides alarms, status and diagnostics of the actuator automatically over a communications bus.

12. The actuator system of claim 6, wherein the processor provides on a communications bus one or more diagnostics items of a group consisting of high temperature warning, excessive noise on power line, record/report back electromotive force (EMF) on spring return, percentage of life detection, high amount of travel for given amount of time, hunting around a given point, actuator angle, communication normal indicator, stroke limiting, control valve (Cv) selection, flowrate on pressure independent control valve (PIC-V), set auxiliary switch, report auxiliary switch setting, report auxiliary switch status, report auxiliary switch current draw—auxiliary equipment status, if switch drives fan—verify fan shuts down before damper closes, if switch drives coils—verify heat exchanger running before opening/closing valve, report stuck valve/damper, PIC-V constant pressure—constant torque, changeover valve—no cycling for a period of time, time since last movement, date/time of first operation (commissioning), audible/detectable signal for location, device in warranty, device model number/serial number/date code, device type—outside air damper/standard ball valve/PIC-V valve/mixed air damper, actuator fitness/self-test routine—known system conditions, sensor—actual damper/valve position, super capacitor status, and energy consumption.

13. A method for attaining diagnostics of an actuator for use in heating, ventilating and air conditioning (HVAC), comprising:

entering a diagnostics program for an HVAC actuator into a processor of the actuator;

transmitting results of the diagnostics program on a communications bus; and reviewing the results from the communications bus; and wherein the actuator comprises:

a motor;

a gear train connected to the motor;

an actuator shaft coupling connected to the gear train;

a shaft position indicator connected to the actuator shaft coupling and to the processor; and one or more sensors situated at the actuator and connected to the processor;

sending an alarm via the processor to a controller via the communications bus if the actuator shaft coupling fails to move upon transmitting signals to the processor commanding a movement of the motor; and wherein the controller is an economizer.

14. The method of claim 13, wherein the communications bus is a two-wire polarity-insensitive bus which can convey signals and power.

15. The method of claim 14, wherein:

two or more actuators are connected to the communications bus.

16. The method of claim 13, wherein the diagnostics program having alarms and diagnostic characteristics is implemented in firmware of the processor.

17. The method of claim 13, wherein the processor provides on the communications bus one or more actuator related items of a group consisting of high temperature warning, excessive noise on power line, record/report back electromotive force (EMF) on spring return, percentage of life detection, high amount of travel for given amount of time, hunting around a given point, actuator angle, communication normal indicator, stroke limiting, control valve (Cv) selection, flowrate on pressure independent control valve (PIC-V), set auxiliary switch, report auxiliary switch setting, report auxiliary switch status, report auxiliary switch current draw—auxiliary equipment status, if switch drives fan—verify fan shuts down before damper closes, if switch drives coils—verify heat exchanger running before opening/closing valve, report stuck valve/damper, PIC-V constant pressure—constant torque, changeover valve—no cycling for a period of time, time since last movement, date/time of first operation (commissioning), audible/detectable signal for location, device in warranty, device model number/serial number/date code, device type—outside air damper/standard ball valve /PIC-V valve/mixed air damper, actuator fitness/self-test routine—known system conditions, sensor—actual damper/valve position, super capacitor status, and energy consumption.

18. An actuator system for use with heating, ventilating and air conditioning (HVAC) equipment, comprising:

an HVAC actuator; and wherein the actuator comprises:

a motor;

a motor controller connected to the motor;

a processor connected to the motor controller; and a coupling for a shaft connection attached to an output of the motor; and wherein:

the processor comprises a diagnostics program;

the processor is connected to a communications bus; and diagnostic results of the diagnostics program are communicated from the processor over the communications bus to a system controller wherein the system controller:

identifies an actuator as communicating diagnostic results according to an address of the actuator; and is an economizer.

* * * * *